US007908688B2

(12) United States Patent
Tompkins

(10) Patent No.: US 7,908,688 B2
(45) Date of Patent: Mar. 22, 2011

(54) PORTABLE VENTILATION SYSTEM

(76) Inventor: Kurt West Tompkins, Snook, TX (US)

( * ) Notice: Subject to any disclaimer, the term of this patent is extended or adjusted under 35 U.S.C. 154(b) by 0 days.

(21) Appl. No.: 12/589,397

(22) Filed: Oct. 22, 2009

(65) Prior Publication Data

US 2010/0221994 A1 Sep. 2, 2010

Related U.S. Application Data

(63) Continuation of application No. 11/937,494, filed on Nov. 8, 2007, now abandoned, which is a continuation of application No. 10/970,341, filed on Oct. 21, 2004, now abandoned.

(51) Int. Cl.

| | |
|---|---|
| ***A47C 21/04*** | (2006.01) |
| *A61F 7/00* | (2006.01) |
| *F24F 13/00* | (2006.01) |
| *F24F 9/00* | (2006.01) |
| *F24F 7/00* | (2006.01) |
| *B08B 15/02* | (2006.01) |
| *F23J 11/00* | (2006.01) |
| *F24C 15/20* | (2006.01) |

(52) U.S. Cl. ..... 5/423; 5/421; 454/192; 454/63

(58) Field of Classification Search ..... 5/421, 423, 5/284, 652, 726, 941; 415/60–61, 211.2; 454/56, 63, 191, 192

See application file for complete search history.

(56) References Cited

U.S. PATENT DOCUMENTS

| | | | | |
|---|---|---|---|---|
| 3,173,710 A * | 3/1965 | Kinnison | ..... | 285/9.2 |
| 3,230,556 A * | 1/1966 | Shippee | ..... | 5/423 |
| 3,713,182 A * | 1/1973 | McNeal | ..... | 5/421 |
| 4,602,486 A * | 7/1986 | Weinstein | ..... | 62/261 |
| 7,037,188 B2 * | 5/2006 | Schmid et al. | ..... | 454/187 |

* cited by examiner

*Primary Examiner* — Jonathan J Liu
(74) *Attorney, Agent, or Firm* — John R Casperson

(57) ABSTRACT

Provided herein is a portable device useful for providing ventilation to a selected area via circulation of ambient air. A device according to the present invention is especially well-suited to provide ventilating air to a person resting on a bed, by directing air from the room to the volume defined by the top surface of the mattress of the bed and a bed covering disposed thereon. Use of the present invention increases the ability of persons to achieve restful sleep by enabling convenient control of the air surrounding the person to a comfortable level.

13 Claims, 23 Drawing Sheets

PORTABLE VENTILATION SYSTEM

CROSS REFERENCE TO RELATED APPLICATIONS

This application is a continuation of U.S. patent application Ser. No. 11/937,494, filed Nov. 8, 2007, now abandoned, which was a continuation of U.S. patent application Ser. No. 10/970,341 filed Oct. 21, 2004, now abandoned.

TECHNICAL FIELD

This invention relates generally to devices useful for providing ventilation by circulating ambient air. More particularly, it relates to portable devices that are useful for circulating the air surrounding a person resting on a substantially flat surface, such as a bed.

BACKGROUND

It is fairly common knowledge that on average, people spend about ⅓ of their lives sleeping. However, there are many people whose sleeping activity does not fall within the average, and of these people a substantial proportion experience one or more common sleeping disorders. While a detailed discussion of the number and types of sleep disorders is beyond this specification, it is nevertheless worthy of mention that most of the people who experience sleep disorders typically achieve less sleep than they generally desire. Sleep deprivation is known to alter cerebral behavior, as shown by hundreds of readily-available studies in the field of psychology, including MRI scans of the temporal lobe of the cerebral cortex of sleep-deprived persons versus persons well rested during verbal learning tests. (Nature magazine, Feb. 10, 2000 issue by author Sean Drummond, et al). Sleep deprivation has been shown to correlate with increased rates of suicide, increased divorce rates, and increased mental stress, which can in many cases set the foreground for the development of more serious chronic disorders. Therefore, it is clear that successfully assisting a person who suffers from a sleep disorder in restoring their body's natural sleeping patterns is an achievement of multi-faceted benefit.

There are a many causes of the various known sleep disorders. Of these causes the physical comfort of the person attempting to sleep or rest is paramount, for if a person's ambient surroundings are not conducive to their personal comfort, sleep can become extremely difficult to achieve, if at all. One factor in the person's environment that has a bearing on their ability to achieve sleep is the ambient temperature. If the temperature of the surroundings of a person is either too hot or too cold, restful sleep may be impossible. Of particular concern is the case where the surroundings are too hot, because in such cases the body's ability to control its internal temperature may be effected to the point where the body begins to sweat, and it is nearly impossible to achieve restful sleep while sweating. Thus, maintaining the ambient temperature at a level which is conducive to sleep is a key to enabling a person to sleep.

Means for controlling the ambient temperature in a person's surroundings are known to include the provision of "air conditioning" in which an air conditioner utilizing the principles of Joule-Thomson cooling is employed to extract heat from a volume of air, such as a bedroom. While air conditioners are highly effective at coarsely controlling the temperature in a room, the customary preference for persons to sleep beneath one or more bedsheets, covers, blankets, etc. coupled with the body's tendency to liberate heat during its normal operation translates to the well-known situation in which the person resting beneath the sheets cannot get comfortable because they are too hot, which is compounded by the proposition that if they remove the covers or sheets from themselves then they become too cold. Owing to variance between selected individual human subjects' metabolism, genetics, etc. the method used in the fine tuning control of one's body temperature becomes a matter of personal taste or preference, and many individuals have typically been observed to develop their own personal habits of effecting such fine tuning, such as sleeping with more or less clothing, permitting part of the body to be exposed to the open air, etc. In spite of these efforts, however, perfect control of the temperature of ambient surroundings of persons desiring to sleep has been fleeting. This fact is evidenced by the myriad of schemes and contrivances provided by workers in the prior art for effecting thermal control over a bed or region in which a person normally rests for sleep, the following few of which are exemplary, and are herein incorporated by reference in their entirety. U.S. Pat. No. 1,142,876 discloses a mattress having perforated conduits disposed along the edges of the mattress, and deflectors overhanging the perforations. There is a means for sucking air simultaneously through the perforations of all of the conduits. U.S. Pat. No. 2,097,751 provides a mattress comprising a bedstead having: a) two bed posts; b) an air pump; c) a conduit leading from the air pump to the first of the bed posts; d) a manually operable valve in the conduit disposed adjacent to the first bed post; and e) a tube rotatably-journalled in the first two bed posts. The tube has a plurality of apertures disposed in a straight line, with one end of the tube being connected to the valve and the opposite end of the tube being closed by a plug carried in the second bed post. There is also provided a means for rotating the tube. Air is forced in jets through the apertures by the pressure generated by the pump and may be directed at any desired angle to the vertical. U.S. Pat. No. 2,461,432 teaches an air conditioning device for beds having a bedstead, a mattress supported on the bedstead and constructed with inlet and outlet ports and passages through the interior of the mattress connecting the ports. The invention includes a wall means surrounding the mattress above the top surface thereof. There is also a passage means from above the top of the mattress to the inlet, and a means for circulating air through the mattress passages by way of the inlet port, the passages, and the outlet port into the wall surrounded space, above the mattress, and then via the passage means back to the inlet port for recirculation through the mattress passages. There is also a means for causing a change in the temperature of the circulated air prior to its entry into the mattress passages. U.S. Pat. No. 3,444,922 sets forth an apparatus for regulating the temperature and humidity about the body of a person in a bed by circulating air in a progressive flow around the person's body. The invention uses a double-chambered bellows having inlet and outlet provisions for each chamber. The device includes a thermostat-controlled refrigeration device. U.S. Pat. No. 3,713,182 describes a device for elevating clothing above a bed and warming the air beneath the clothing. The invention utilities two hollow tubular arms which are vertically mounted on a side of the bed, and at a flexible line over which the clothing is draped. There is a small blower having a heating unit disposed beneath the bed, whose discharge is directed into the bed through passages formed in the flexible line. U.S. Pat. No. 4,602,486 provides a portable apparatus for cooling a selected region, such as around a bed, the apparatus comprising a portable enclosure for encompassing the region and defining an opening at the upper part of the region, the enclosure comprising: i) a frame for extending around the periphery of the region; ii) a frame support means for supporting the frame at a predetermined elevation relative to the region; and iii) a flexible sheet material hanging from the frame for encompassing the region and for defining an opening at the upper part of the region. The frame is pivotally mounted to the frame support means, and the enclosure further includes a torsion spring on the frame support means, whereby the spring may be engaged with the frame for biasing the frame to a normal position generally parallel with the floor, but permitting pivoting of the frame from the normal position to facilitate ingress and egress. There is also a portable cooling assembly including (i) a movable support structure for being positioned on the floor adjacent the region and having an upper end for being positioned adjacent the opening, (ii) a heat exchanger mounted to the upper end of the support structure for being positioned at an elevation adjacent the opening over a portion of the region, and (iii) means for circulating coolant through the heat exchanger whereby ambient air is cooled by the heat exchanger and flows downwardly into the region. U.S. Pat. No. 4,660,388 sets forth a generally-rectangular cooling cover adapted to be positioned over a human body in a prone position, the cooling cover comprising: a coverlet having an outer sheet, an inner porous pouch attached to the outer sheet, and an inner pad within the porous pouch. The inner pad includes a pair of upper and lower sheets formed of an air-impermeable material, with the upper sheet adjacent the coverlet and the lower sheet adjacent the porous pouch. The sheets are secured to each other along their outer edges to form an air distribution chamber therebetween, and are secured to each other along a plurality of parallel intermediate portions extending lengthwise between the ends of the sheets for a major portion thereof, to form a plurality of separate longitudinally extending air passages therebetween having lower rounded surfaces, and a plenum chamber extending transversely of the pad at each end thereof in fluid communication with the longitudinally extending air passages, and a cool air inlet at one end of the inner pad. The coverlet has an opening therein in alignment with the inlet of the pad adapted to receive a source of cool air for connection to the inlet. The lower rounded surfaces have a plurality of apertures along the length thereof at locations other than the lowermost portion of the rounded surfaces, and in fluid communication with the longitudinally extending passages whereby cool air may be discharged as small jets through the apertures at an angular relation to a vertical plane for diffusing through the porous pouch to contact a large area of the body cooled. U.S. Pat. No. 4,777,802 describes a blanket for connection with a supply of pressurized temperature-modified air, comprising: a) an outer layer constructed of an air-impervious material; b) an inner layer constructed of a material readily permeable by pressurized air, with the inner layer being arranged with most of its surface area contacting the outer layer; c) a sealing means interconnecting the outer and inner layers arranged in a substantially continuous closed path leaving an unsealed and separable portion of the outer and inner layers inwardly of the sealing means; and d) an inlet means communicating with the unsealed portion between the outer and inner layers for introducing the pressurized temperature-modified air therein at least a part of which pressurized air exits through the inner layer. U.S. Pat. No. 4,939,804 provides an apparatus for ventilating a bed in a room, the bed having a head, a foot, and a mattress positioned above a box spring The apparatus comprises: a) an elongate housing having an upper extent and a lower extent, and having a longitudinal axis which is positionable parallel to the foot of the bed, with the upper extent of the elongate housing being provided with at least one air inlet opening for receiving stale air, the elongate housing to also having an outlet duct for exhausting air into the room; b) at least one mounting flange extending outwardly from the elongate housing generally perpendicular to the longitudinal axis thereof, with the mounting flange being adapted to be received between the mattress and box spring for supporting the elongate housing on the bed; c) a filtration means located between the air inlet opening to the elongate housing and the outlet duct for filtering the stale air entering the housing; d) at least one recirculating duct associated with the elongate housing for recirculating filtered air from the elongate housing back to the bed; and e) a fan means for drawing air through the air inlet opening, for exhausting filtered air out the outlet duct and for recirculating a portion of the filtered air through the recirculation duct. U.S. Pat. No. 5,730,120 discloses a ventilator for a bed, comprising abase means having a thin flat section that is adapted to be sandwiched between a mattress and a supporting bed structure, and having a cantilevered outer end section extending outwardly of an edge of the mattress for supporting, which includes: i) a fan means supported from the outer end section of the base and having a lower inlet for receiving air flow from a level below the mattress and a outlet for directing air upwardly toward an upper surface of the mattress; and ii) an elbow means for directing the air flow received from the outlet of the fan means over the upper surface of the mattress inwardly of the edge thereof, wherein the fan means and the elbow means include an air duct having an intake opening at a lower end for receiving incoming air flow for ventilating the bed. U.S. Pat. No. 6,425,527 sets forth a device for controlling a temperature of a person's sleeping environment, comprising: a) a means for drawing a vacuum to draw air from a sleeping environment; b) a means for fluidly connecting the sleeping environment to an intake port of the vacuum means; c) a means for determining a temperature of the air drawn from the sleeping environment; and d) a means for adjusting the speed of the air being drawn out of the sleeping environment based upon the temperature of the air. U.S. Pat. No. 6,473,920 describes an apparatus to manage the temperature of a supine person's lower extremities in a bed by directing air over a bed, comprising: a) a tubular air permeable distribution chamber comprising a length of open cell foam; b) a temperature-regulating blower coupled to the chamber for blowing warmed air from the blower into the chamber; and c) mounting hardware shaped to position the chamber at a foot of a bed where air at a normothermic temperature is directed from the chamber, over the bed. U.S. Pat. No. 6,546,576 provides an improved structure of a ventilated mattress with cooling and warming effect, which comprises: a) a mattress body; b) a warming/cooling air-delivery controlling box; and c) a connecting tube. The control box produces warming/cooling air to the mattress body via the connecting tube, and the warming/cooling air is released via a plurality of ventilation buttons mounted at the surface of the mattress body. The mattress thereby provides the user with a warming/cooling effect. U.S. Pat. No. 6,701,552 describes a warm-air blower for use with air-controlled bedding which comprises a quilt and a futon, which is used to control the sleeping environment by supplying warm air or cool air to the bedding. According to the invention the warm air blower unit has an air intake near a left- or right-hand side of its front surface, and the air taken in from the air intake is led so as to flow through the interior of the warm air blower unit to a fan. The fan is positioned at a distance from the air intake, and the warm air passing through the heater chamber is blown out of the warm air blower unit through two vertically arranged air outlets. One or optionally both of the outlets are equipped with a shutter that is capable of regulating the airflow. U.S. Pat. No. 6,711,767 provides an apparatus for warming a bed having a mattress covered by a bed covering, which comprises: a) a housing having an air inlet and an air outlet; b) a heater within the housing; c) a fan within the housing for producing a flow of air from the air inlet through the heater to the air outlet; and d) a support adjustably coupled to the housing and adapted to extend under the mattress to hold the housing along an edge of the mattress. The flow of air from the air outlet is directed between the mattress and the bed covering.

While each of the prior art devices and methods achieve to a greater or less extent their desired objectives, they are nevertheless not without features which have heretofore prevented their widespread adoption by large numbers of people. One of the main factors is believed to be the relative complexity of the prior art devices, with their attendant high cost, tedium in operation, and cumbersomeness in appearance and difficulty in retrofitting existing furniture, beds, and the like. Thus, it is clear that if a device were available which enabled a high level of control of the temperature of a person's body during sleep and which device were capable of being readily retrofitted to existing furniture, beds, and the like, that a large number of persons with sleep disorders could find relief from employment of such a device. If such a device were of such simplistic design that it could be manufactured and sold at a cost which is accessible to the predominant majority of persons, such would undoubtedly lead to its adoption. In addition, if such a device were small and portable, so that a user could easily stow it when not in use or transport it conveniently when traveling on the road or when merely switching rooms, such a feature would make adoption of such a device more attractive still. The present invention fulfills all of these needs in the marketplace, in addition to others as one of ordinary skill will come to appreciate by further consideration and understanding of the contents and implications of this specification and the claims appended hereto.

SUMMARY OF THE INVENTION

The present invention provides a device useful for providing a moving current of ventilating air which comprises: a) a base portion having a hollow interior portion which itself further comprises: i) at least one inlet opening through which air may be admitted, and ii) an exit opening through which air may exit the hollow interior portion; b) an air conduit channel means having an inlet end portion and an outlet end portion; wherein the inlet end portion of the air conduit channel is in effective fluid communication with the exit opening of the base portion; c) at least one fan means disposed between the inlet opening in the base portion and the outlet end portion of the air conduit channel for causing ambient air to flow from the inlet opening of the base portion to the outlet end portion of the air conduit channel; and c) a support bar means adjustably attached to the air conduit channel.

BRIEF DESCRIPTION OF THE DRAWINGS

In the annexed drawings.

DETAILED DESCRIPTION

Figure 1A:
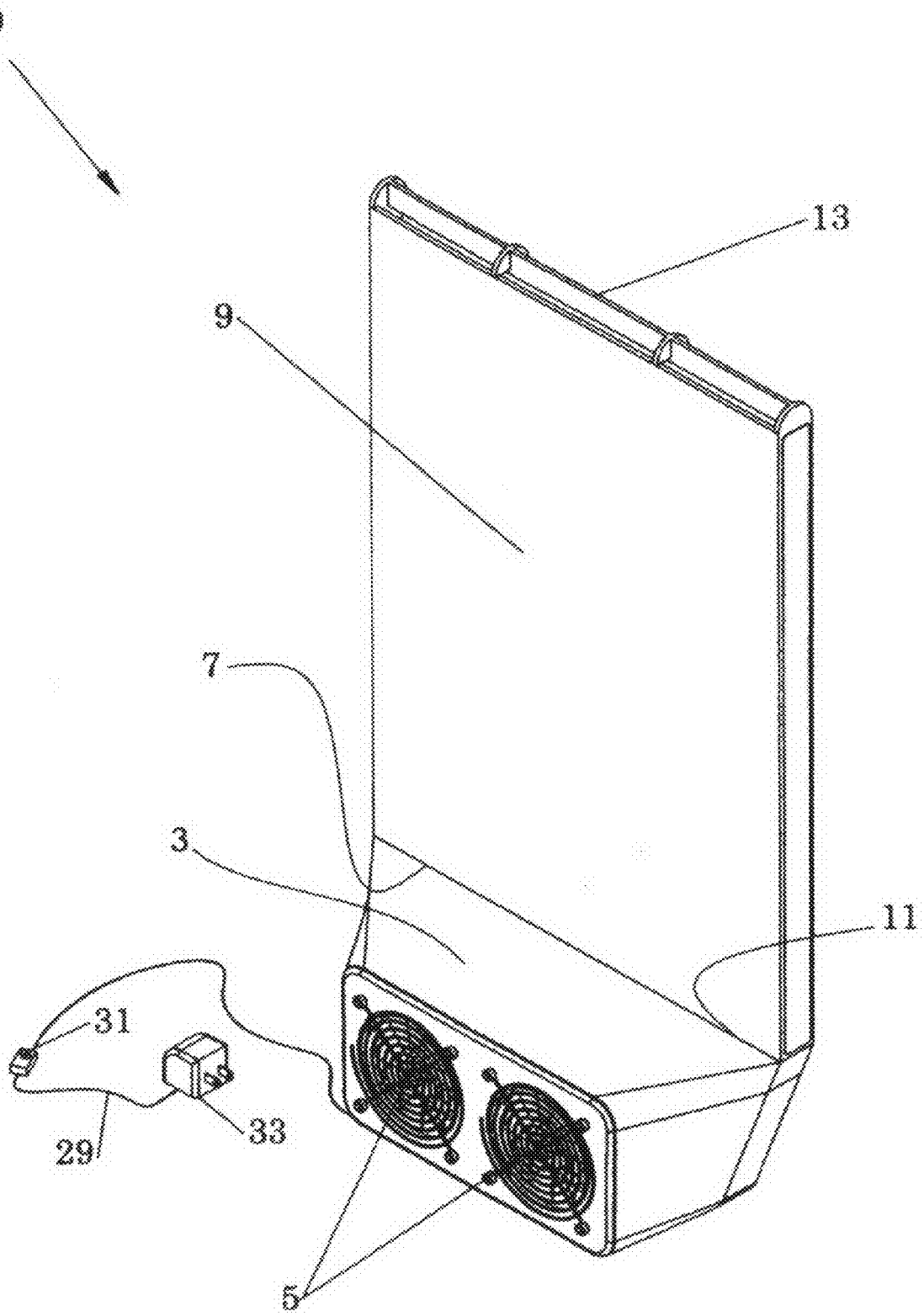
FIG. 1A shows a front perspective view of a device according to one form of the invention.

Referring to the drawings and initially to FIG. 1A, there is shown a front perspective view of a device 10 according to one form of the invention which is shown as comprising a base portion 3 having an interior volume, an inlet opening 5 through which ambient air may be admitted, and an exit opening 7 through which the admitted ambient air may be expelled from the interior of the base portion under the power of one or more fan means which are disposed within the interior volume of the base portion. To the exit opening 7 of the base portion 3, there is attached the inlet end portion 11 of an air conduit channel means 9, through which air that has been discharged from the exit opening 7 of the base portion may enter the conduit channel 9 and under the force of the fan means is conveyed to the outlet end portion 13 of the conduit channel 9. Thus, during the normal operation of a device according to one form of the invention, the fan means thus causes air to be admitted to the inlet opening 5 and to be forced to exit conduit channel 9 at its outlet end portion 13. Also shown in FIG. 1A is the electrical power cord 29 used to supply electrical power to the fan means.

Figure 1B:
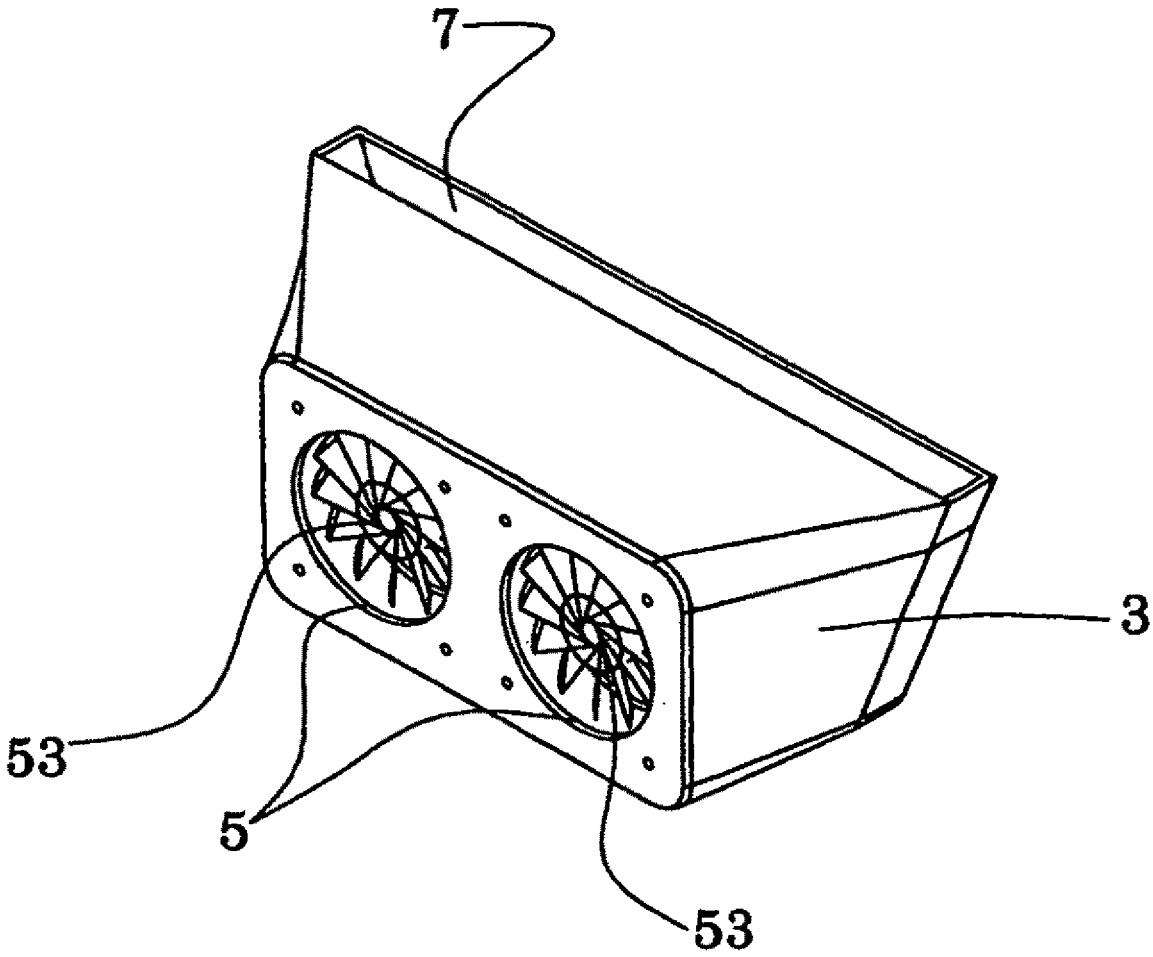
FIG. 1B shows a front perspective view of a base portion element of a device according to one form of the invention.

Some details of a base portion 3 useful in constructing a device according to this invention are shown in FIG. 1B, in which the base portion 3 is seen to comprise a plurality of fan means 53 disposed at the inlet opening of the base portion, and a rectangularly-shaped opening which serves as the exit opening 7 of the base portion 3. During operation of the fan means 53, which preferably comprises one or more conventional fans operated by a DC or AC electric motor, air is drawn into the hollow interior portion of the base portion 3 and expelled out of the opening 7 and into the air conduit channel means as shown and described for FIG. 1A.

The base portion 3 has a dual purpose in a general sense, which on the one hand is to serve as a housing for the fan means 53, that is, the fan means are disposed within the hollow interior volume of the base portion such that their motion draws air into the base portion through the inlet opening(s) 5, and the fan means 53 by its (their) action expels the air through the exit opening 7 of the base portion 3. Since the fan means in one form of the invention are conventional fans with a motor and a blade, their being housed within the base portion prevents the blades motion from being inhibited such as by being struck, touched by a hand, etc., i.e., the base portion acts as a shroud for the fan means. The base portion 3 also serves as the support for the device 10 as a whole, and in many employments of the device it will rest with its base on a horizontal floor or a room in a dwelling or other area. Thus, while the base portion 3 may have outer walls or surfaces which cause it to exist in the configuration of any geometric solid, it preferably comprises a flat bottom portion suitable for enabling the device 10 to rest on a flat surface with the air conduit channel means 9 being disposed so that air is discharged from it in a substantially-vertical orientation. The base portion is in one preferred form of the invention comprised of a plurality of pieces of sheet stock, such as plywood or polyolefin slab stock about ⅛ inch thick, or any functionally-equivalent material of construction. The base portion 3 is preferably comprised of a thermoplastic polyolefin and is injection molded as a single piece having an interior volume of substantially the same shape as defined by its exterior walls, as it may be thought of as being basically a box.

Figure 1C:
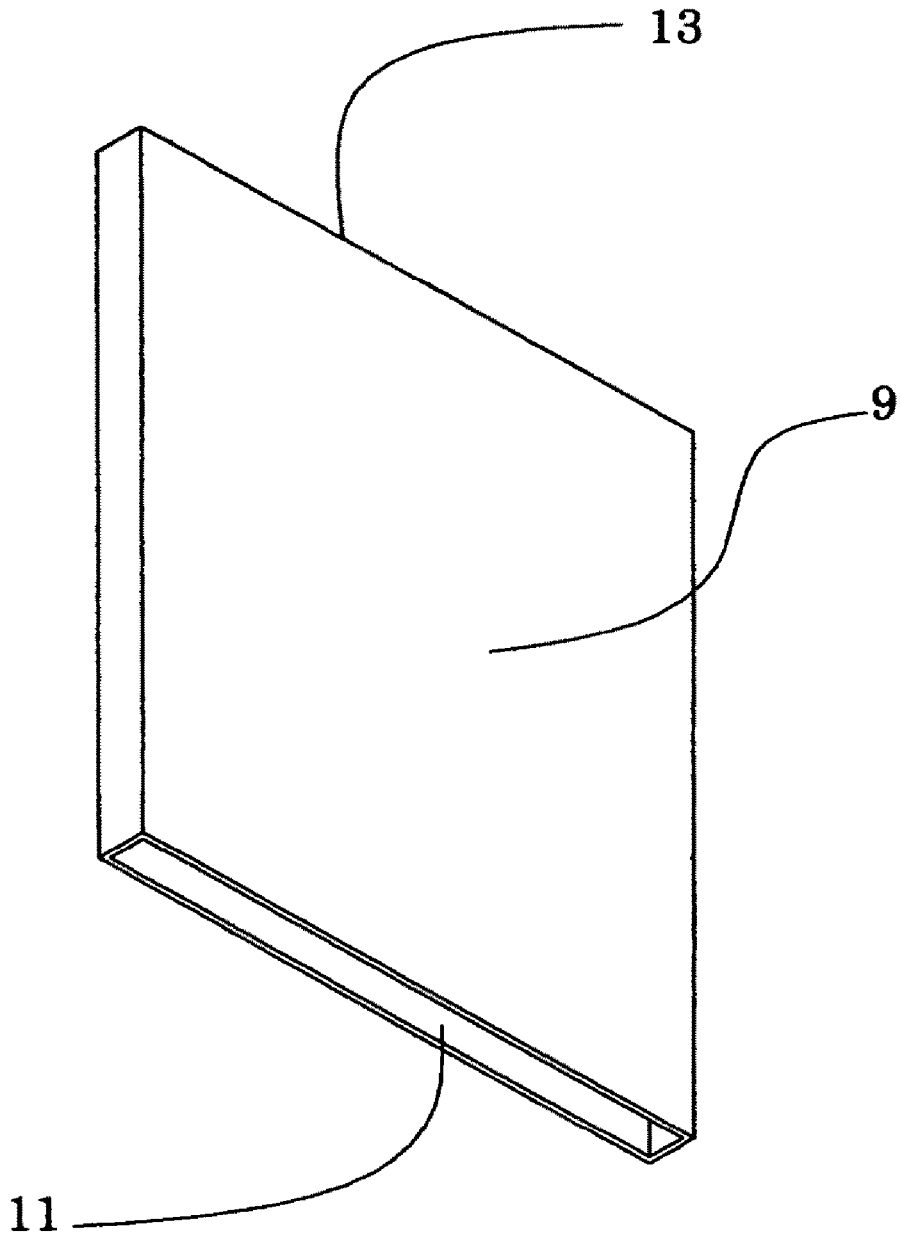
FIG. 1C shows a perspective view of a conduit channel means element of a device according to one form of the invention.

According to a preferred form of the invention, the conduit channel means 9 is configured in the form of a rectangular solid with a hollow interior portion, which, when standing alone has its two end portions open to the ambient surroundings. The purpose for this shape includes provision for convenient aligned mating of the exit opening 7 of the base portion 3 with the open inlet end portion 11 of the air conduit channel means 9 when the exit opening 7 of the base portion 3 is substantially rectangularly-shaped as in a preferred form of the invention. Such configuration of the air channel means also provides a relatively wide zone of air exiting the outlet end portion 13 of the air conduit channel 9 when the device is in operation, as the width dimension of the air channel means 9 is about 12 inches in one preferred form of the invention. The air conduit channel means may be attached to the exit opening 7 of the base portion 3 by conventional means, such as glues, adhesives and the like, and is preferably itself comprised of sheet stock of wood or thermoplastic polyolefin. The base portion 3 and the air conduit channel means 9 may according to one preferred form of the invention be a single construction, prepared by an injection molding process. An air conduit channel means 9 according to one form of the invention is depicted in FIG. 1C. having a rectangularly-shaped inlet portion 11 through which air may pass and be discharged at the outlet end portion 13.

Figure 2:
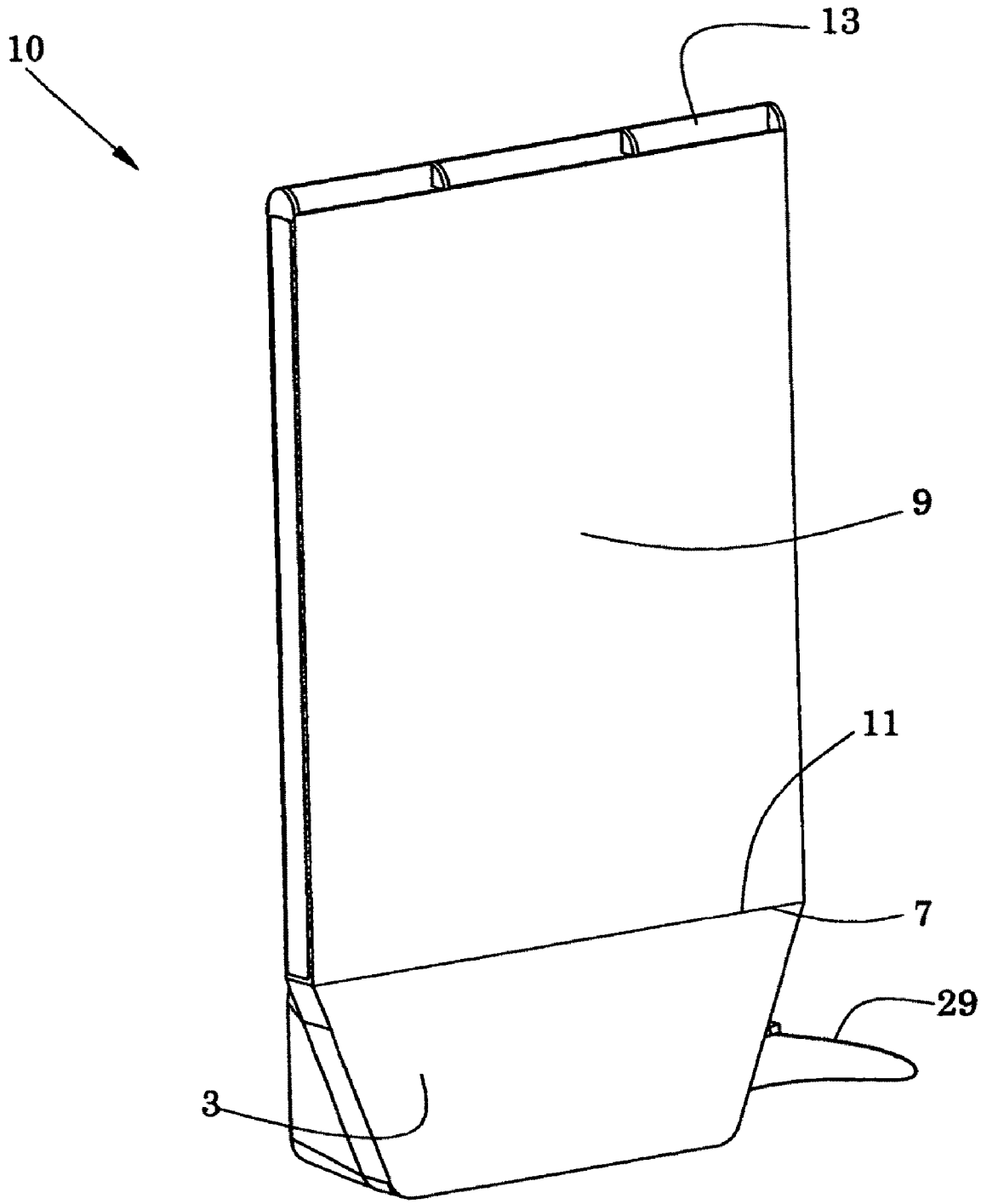
FIG. 2 shows a rear perspective view of a device according to one form of the invention.

FIG. 2 shows a rear perspective view of a device 10 according to one form of the invention and the relationship of the various elements of the invention to one another, including the base portion 3, exit opening 7 of the base position, inlet end portion 11 of the air conduit channel means 9, outlet end portion 13 of the air conduit channel means 9 and the power cord 29.

Figure 3:
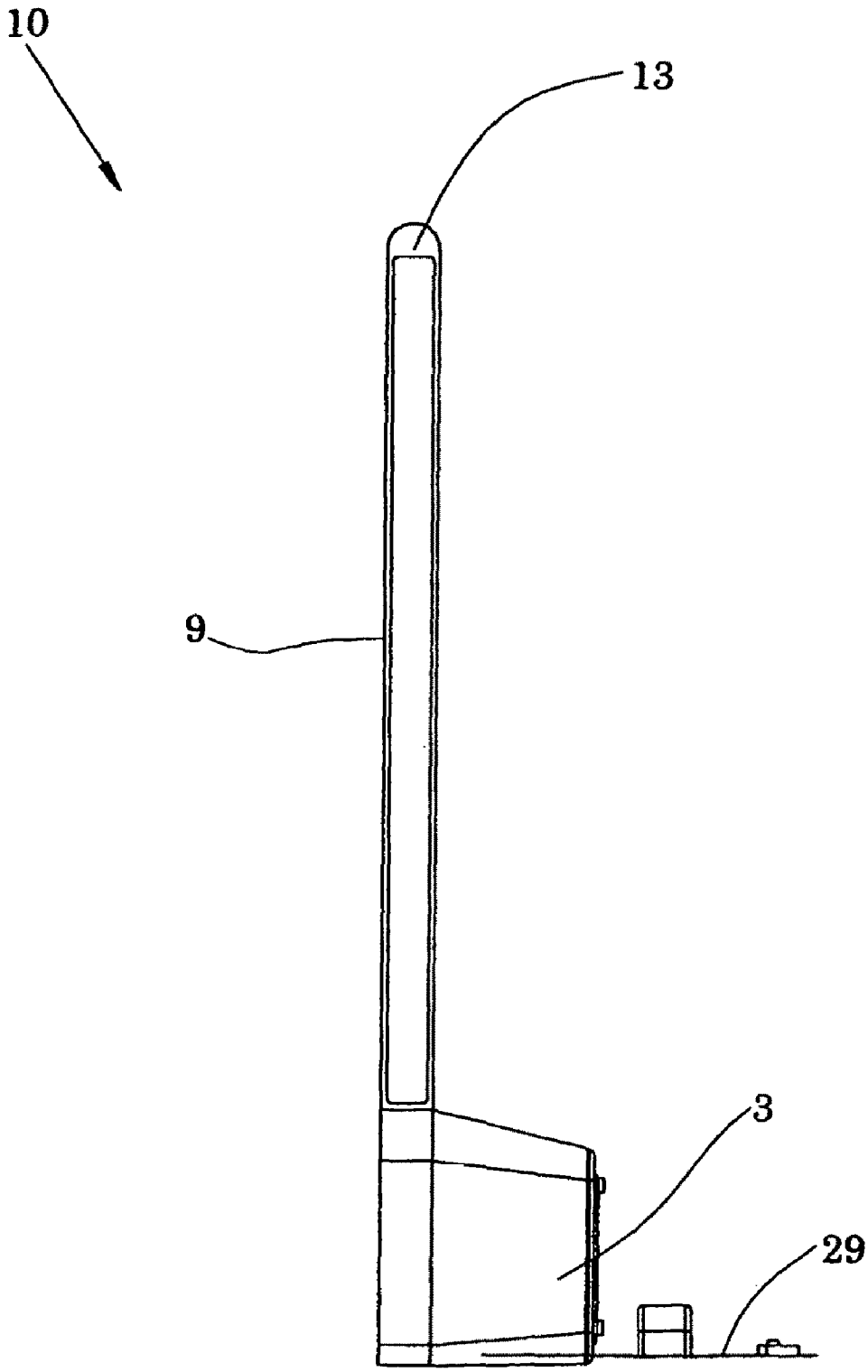
FIG. 3 shows a left side perspective view of a device according to one form of the invention.

FIG. 3 shows a left side perspective view of a device according to one form of the invention and the relationship of the locations of various elements of the invention including the base portion 3, air conduit channel means 9, outlet end portion 13 of the air conduit channel means 9, and power cord 29.

Figure 4:
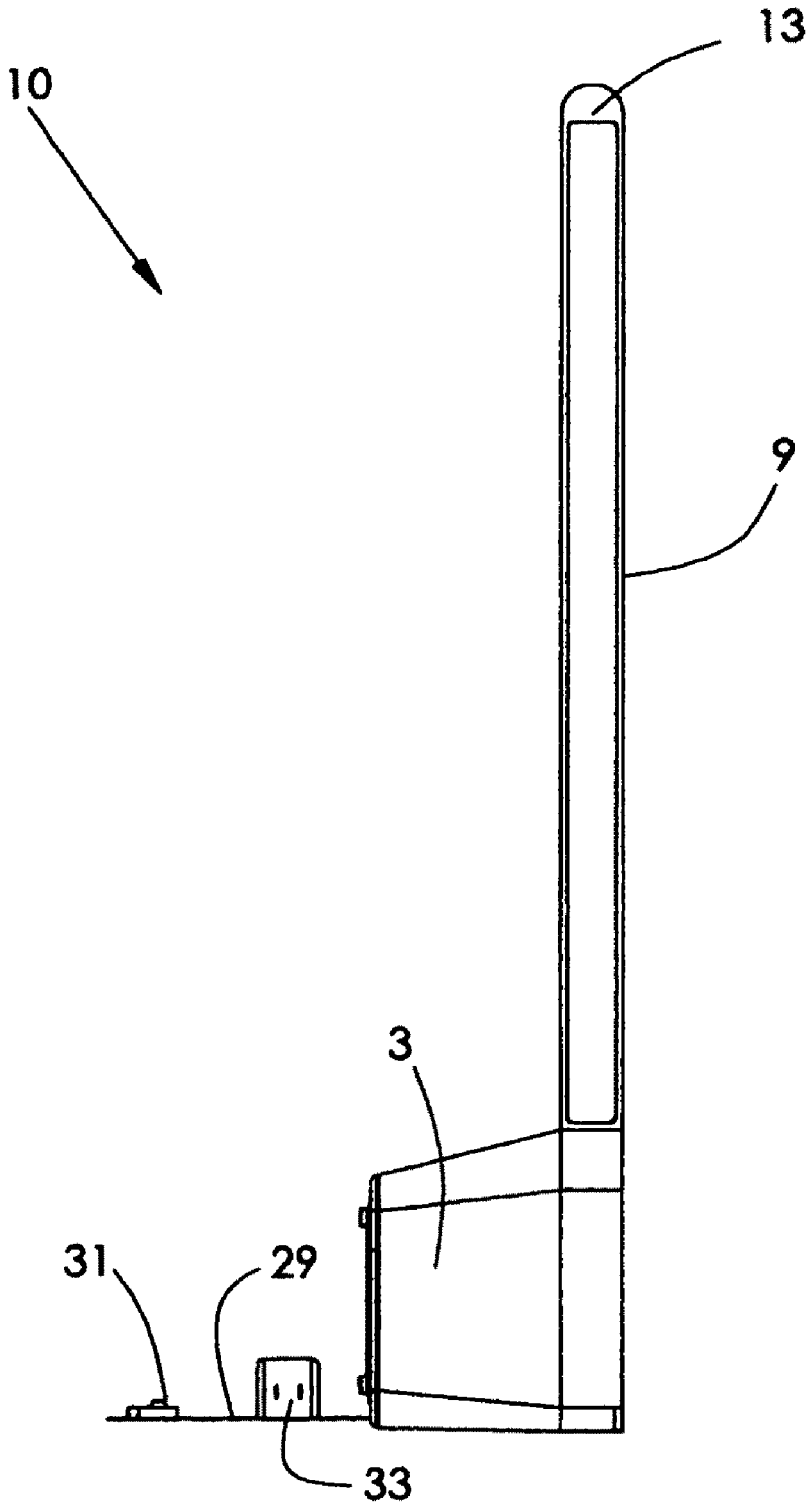
FIG. 4 shows a right side perspective view of a device according to one form of the invention.

FIG. 4 shows a right side perspective view of a device according to one form of the invention and the relationship of the locations of various elements of the invention including the base portion 3, air conduit channel means 9, outlet end portion 13 of the air conduit channel means 9, power cord 29, rheostat 31 and transformer 33. The rheostat 31 is a conventional rheostat or device of equivalent function which serves to controllably regulate the voltage to the fan means so as to permit adjustment of the volume of air exiting the outlet end portion 13 of the air conduit channel means 9 during operation of the device 10.

Figure 5:
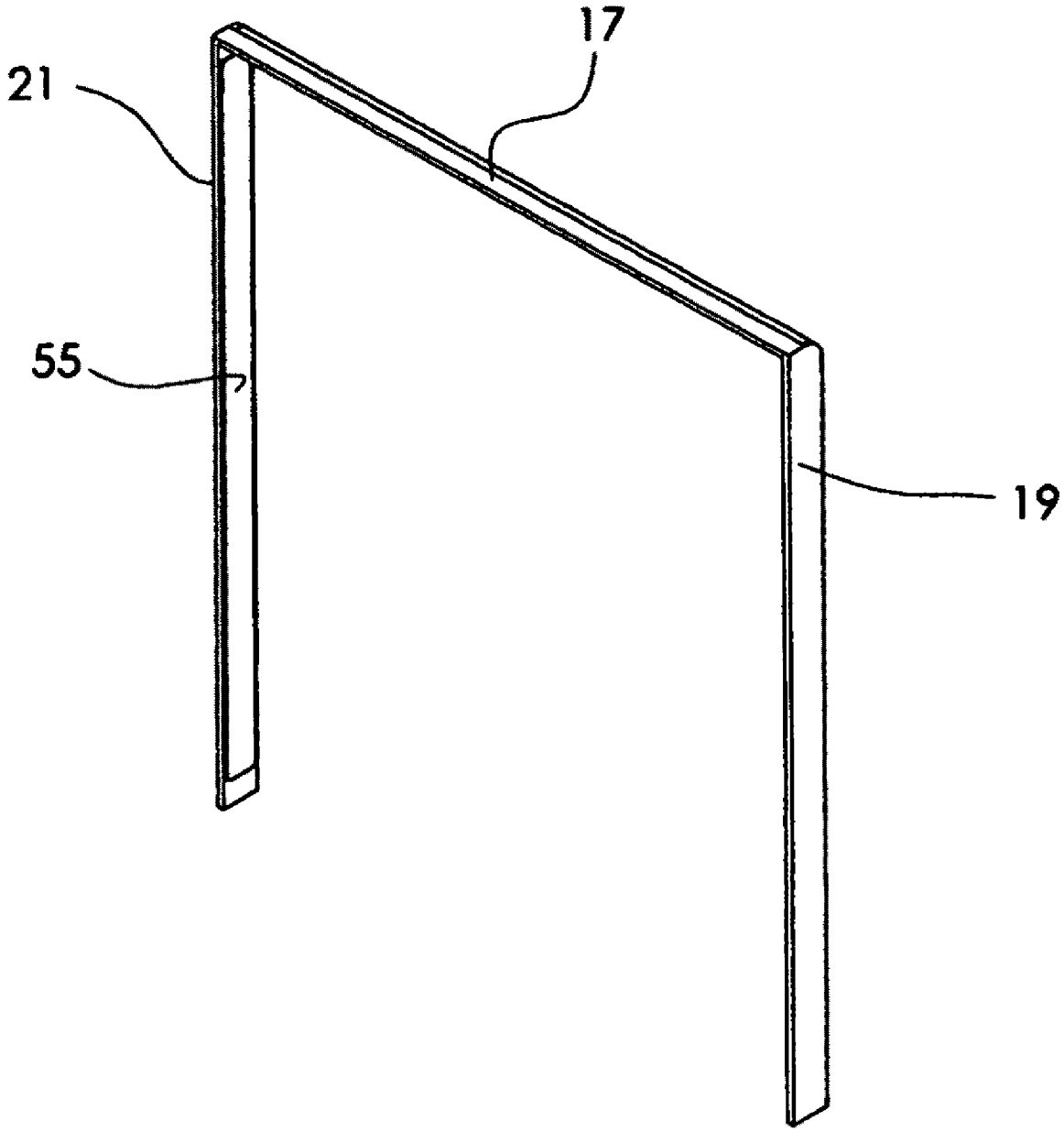
FIG. 5 shows a perspective view of a support bar useful on a device according to one form of the invention.
Figure 6:
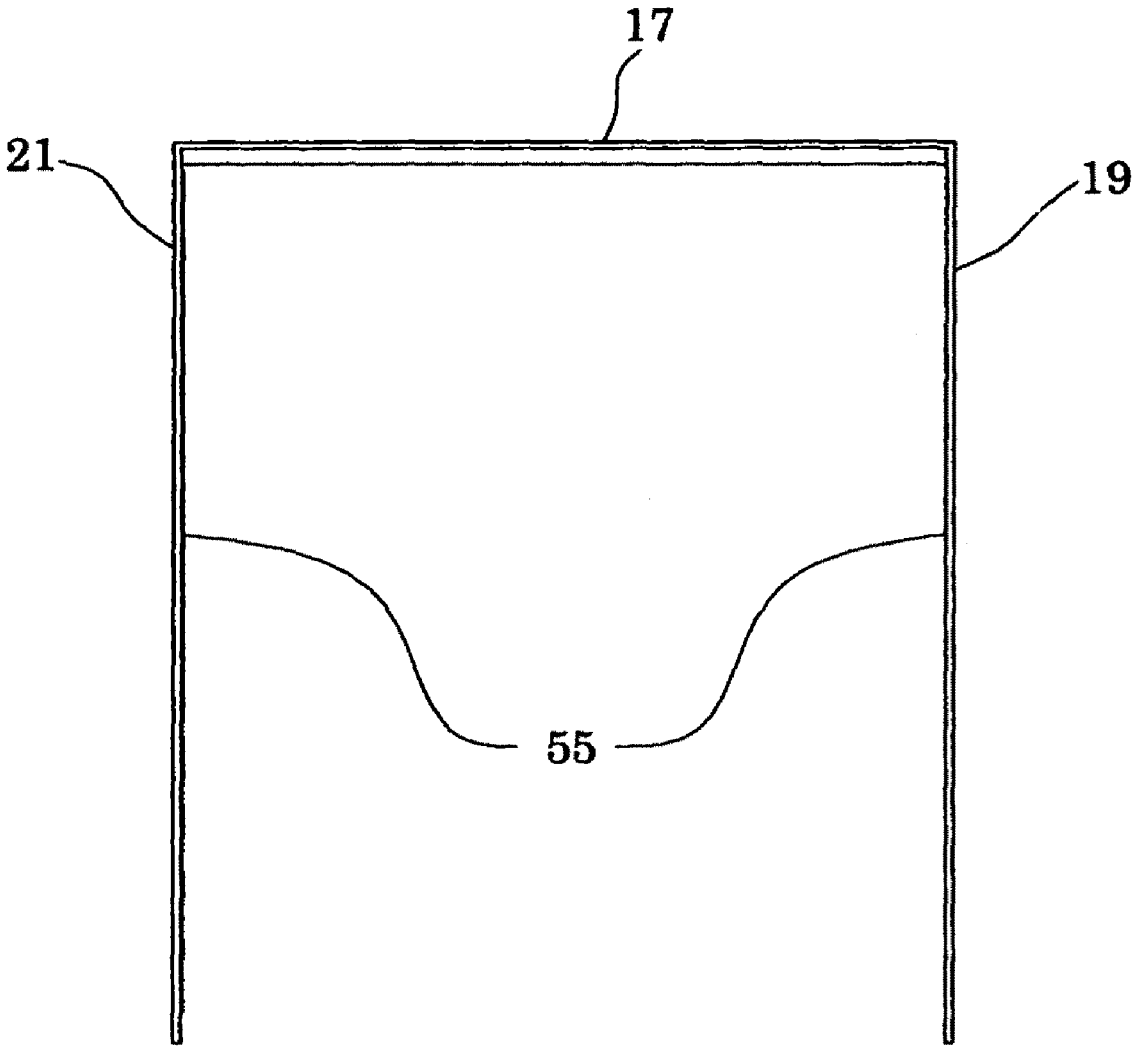
FIG. 6 shows a frontal view of a support bar useful on a device according to one form of the invention.
Figure 7:
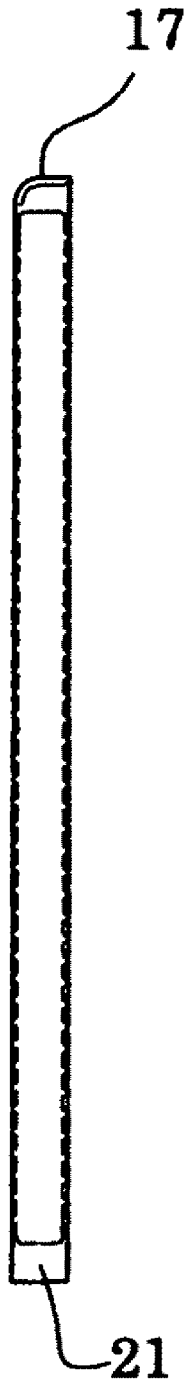
FIG. 7 shows a left side view of a support bar useful on a device according to one form of the invention.

FIG. 5 shows a perspective view of a support bar means 17 useful on a device according to one form of the invention. The support bar means 17 is a thin piece of flat slab stock or extruded stock having an arcuate, c-shaped, or crescent-shaped cross section, which is caused to be disposed directly in the flow of air which exits the outlet end portion 13 of the air conduit means of the invention, so as to re-direct the flow of air which impinges on it. When the cross to section of the support bar means 17 is arcuate, it is preferred that it traces out approximately a 90° arc. The support bar means 17 is attached by means of the right support arm 19 and left support arm 21 to the air conduit channel means 9, preferably by attachment of the support bars to the edges of the air conduit channel by means of conventional fasteners which may include a hook-and-loop type fastening means such as VELCRO® fastening means, with one portion of the fastening means 55 disposed on the inside of the support arms and the complementary counterpart of the fastening means disposed on the external surfaces of the air conduit channel means 9. FIG. 6 shows a frontal view of a support bar means 17 useful on a device according to one form of the invention, depicting the respective locations of the support arms 19 and 21 attached at their end portions to the end portions of the support bar means 17 by conventional means such as an adhesive or conventional fasteners including brackets and the like. In one form of the invention, the support bar means 17 and support arms 19 and 21 are comprised of a single piece of flat sheet thermoplastic polyolefin about ⅛ inch thick having an appropriate length and a width of about 1 inch, which is bent at the appropriate locations. The support bar means in one embodiment is disposed to be substantially parallel to the outlet end portion of said air conduit channel means. FIG. 7 shows a left side view of a support bar means 17 useful on a device according to one form of the invention showing the left support arm 21 and the support bar means 17.

Figure 8:
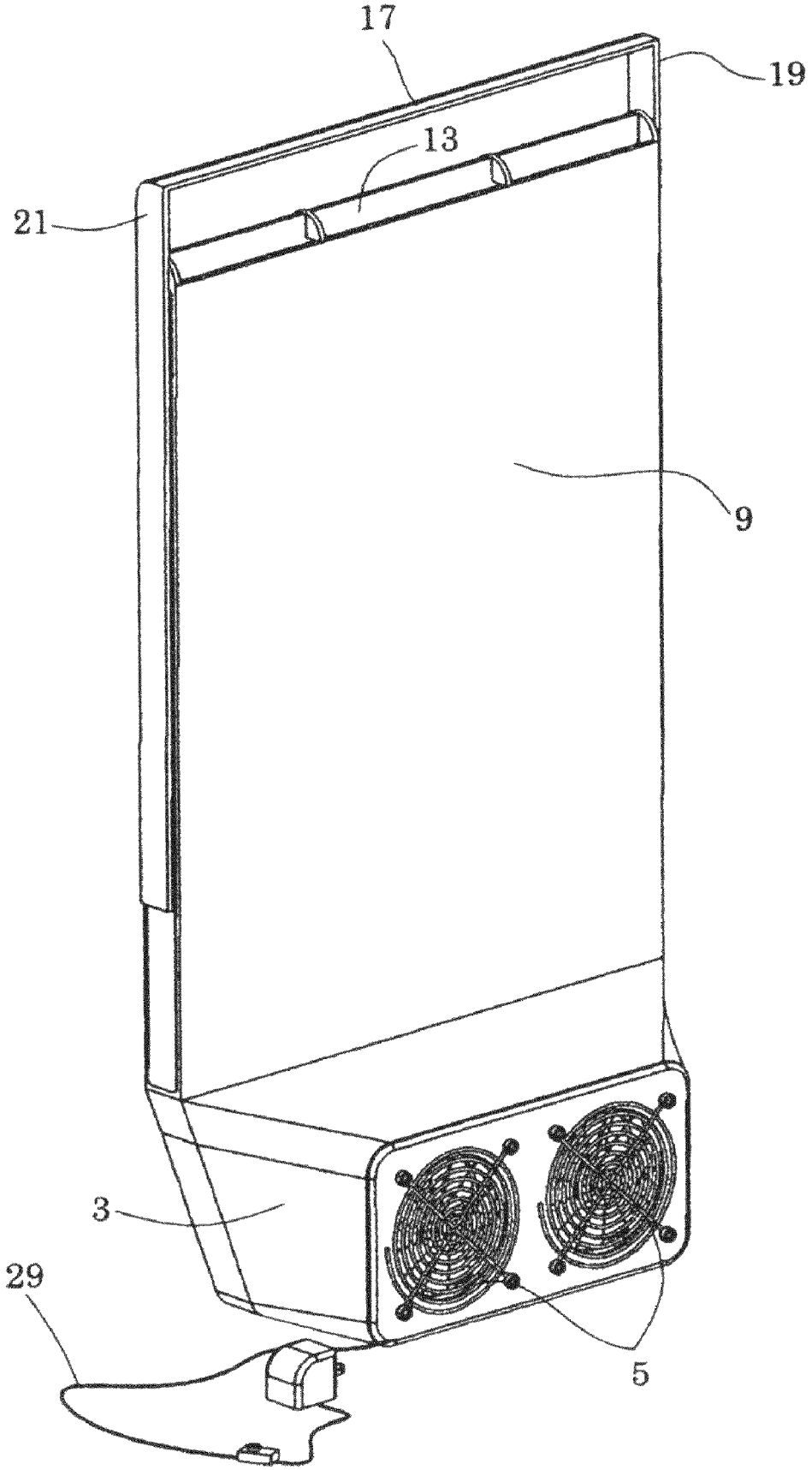
FIG. 8 shows a front perspective view of a device according to one form of the invention having a support bar attached thereto.

FIG. 8 shows a front perspective view of a device according to one form of the invention having a support bar means 17 attached thereto as hereinbefore described and showing the respective locations of the various elements of the invention including the base portion 3, inlet opening 5 of the base portion 3, which may be fitted with an optional screen, air conduit channel means 9, outlet end portion 13 of the air conduit channel means 9, right support arm 19, left support arm 21, the support bar means 17 and the power cord 29.

Figure 9:
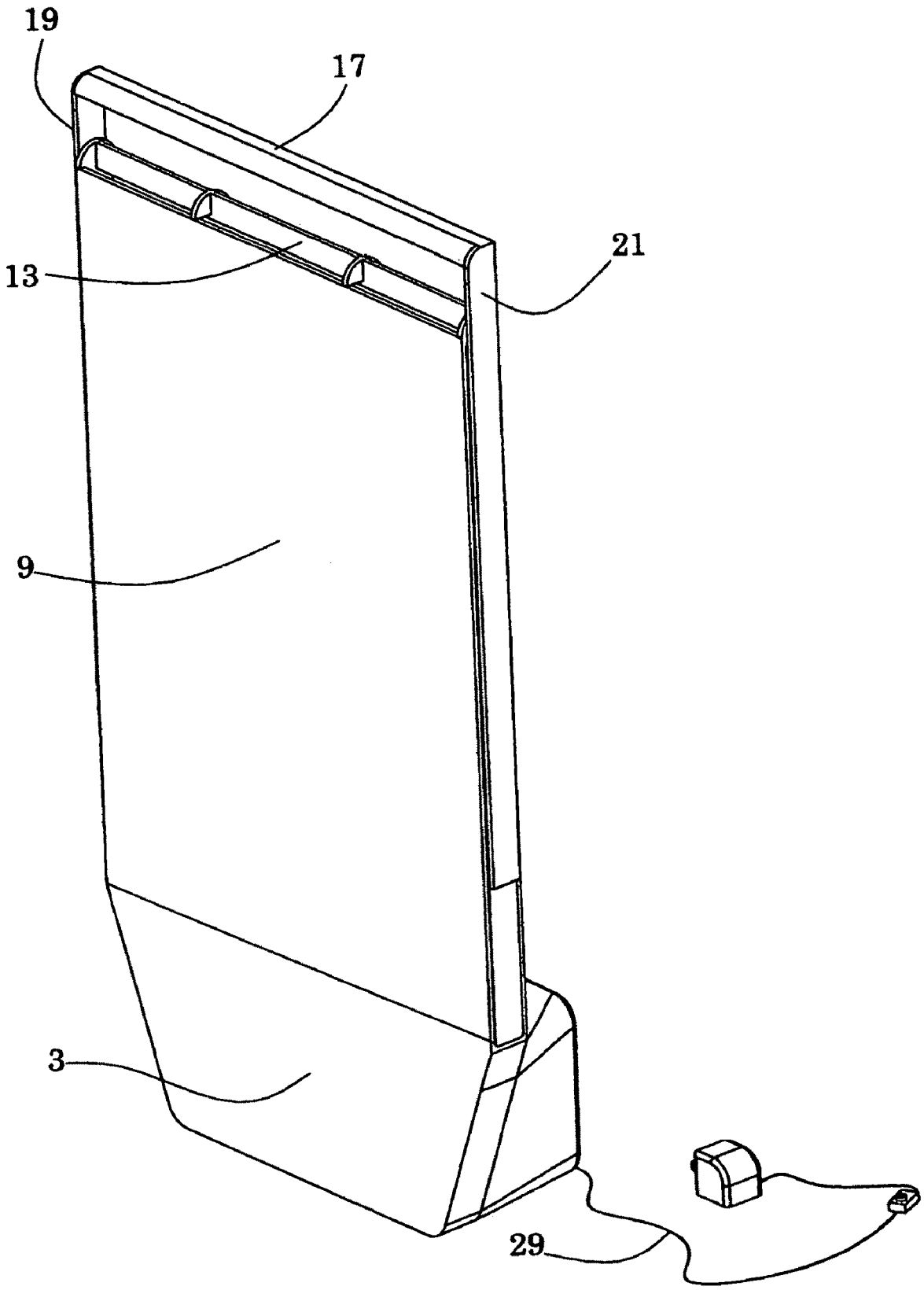
FIG. 9 shows a rear perspective view of a device according to one form of the invention having a support bar attached thereto.

FIG. 9 shows a rear perspective view of a device according to one form of the invention having a support bar 17 attached thereto as hereinbefore described and showing the respective locations of the various elements of the invention including the base portion 3, air conduit channel means 9, outlet end portion 13 of the air conduit channel means 9, right support arm 19, left support arm 21, the support bar means 17 and the power cord 29.

Figure 10:
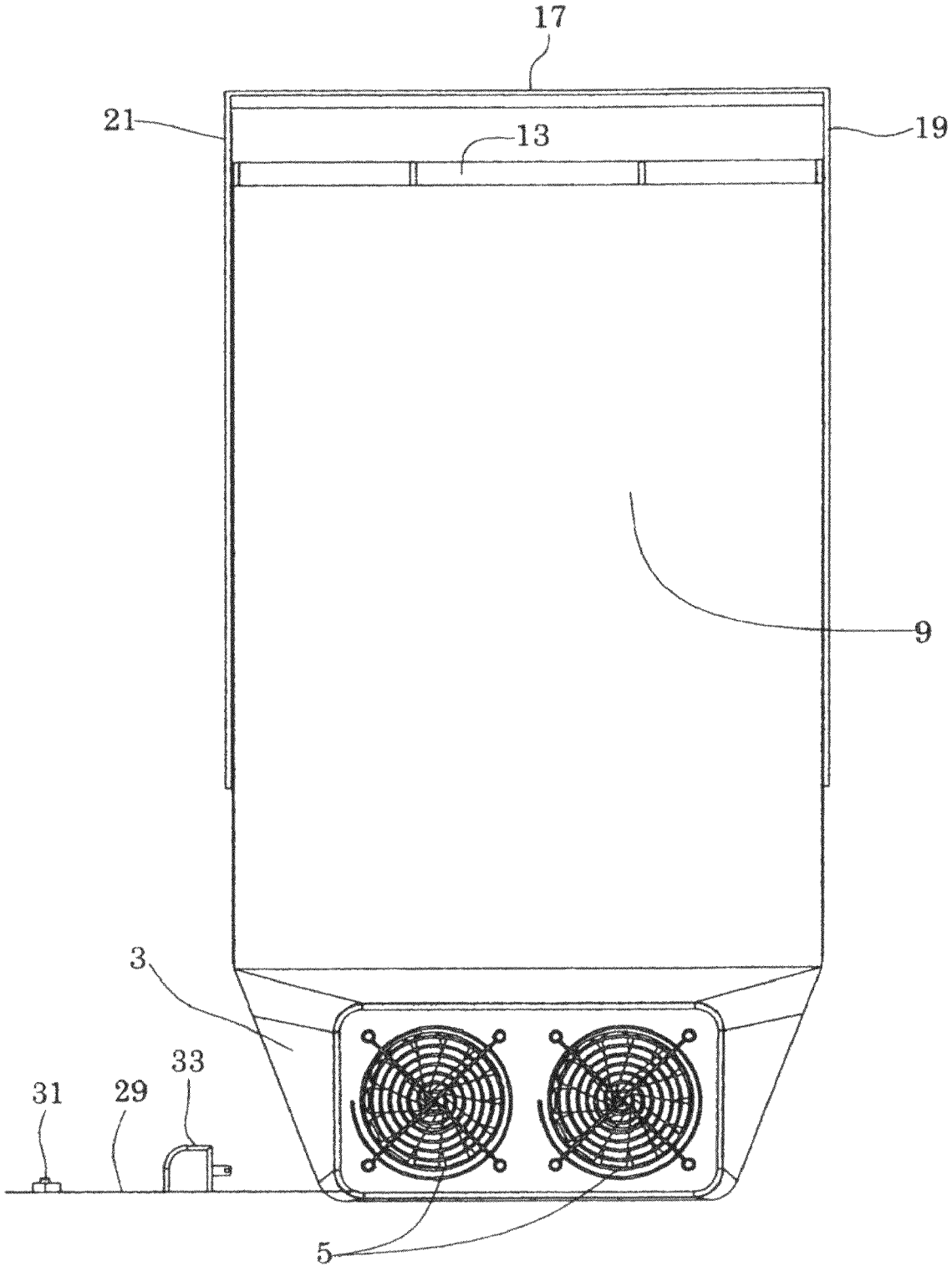
FIG. 10 shows a front view of a device according to one form of the invention having a support bar attached thereto.

FIG. 10 shows a front view of a device according to one form of the invention having a support bar means 17 attached thereto as hereinbefore described and showing the respective locations of the various elements of the invention including the base portion 3, inlet opening 5 of the base portion 3, air conduit channel means 9, outlet end portion 13 of the air conduit channel means 9, right support arm 19, left support arm 21, the support bar means 17 and the power cord 29.

Figure 11:
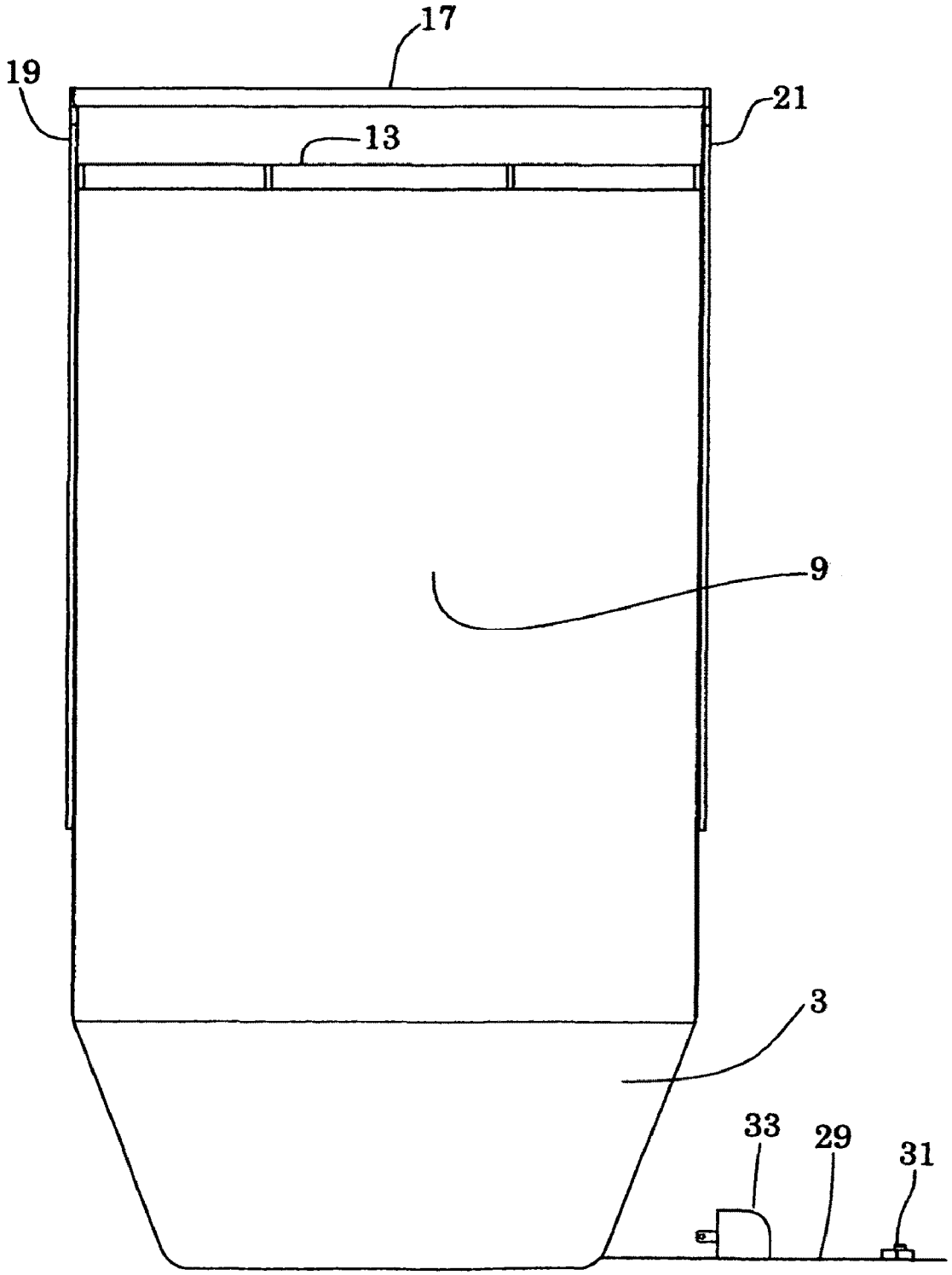
FIG. 11 shows a rear view of a device according to one form of the invention having a support bar attached thereto.

FIG. 11 shows a rear view of a device according to one form of the invention having a support bar means 17 attached thereto as hereinbefore described and showing the respective locations of the various elements of the invention including the base portion 3, air conduit channel means 9, outlet end portion 13 of the air conduit channel means 9, right support arm 19, left support arm 21, the support bar means 17 and the power cord 29.

Figure 12:
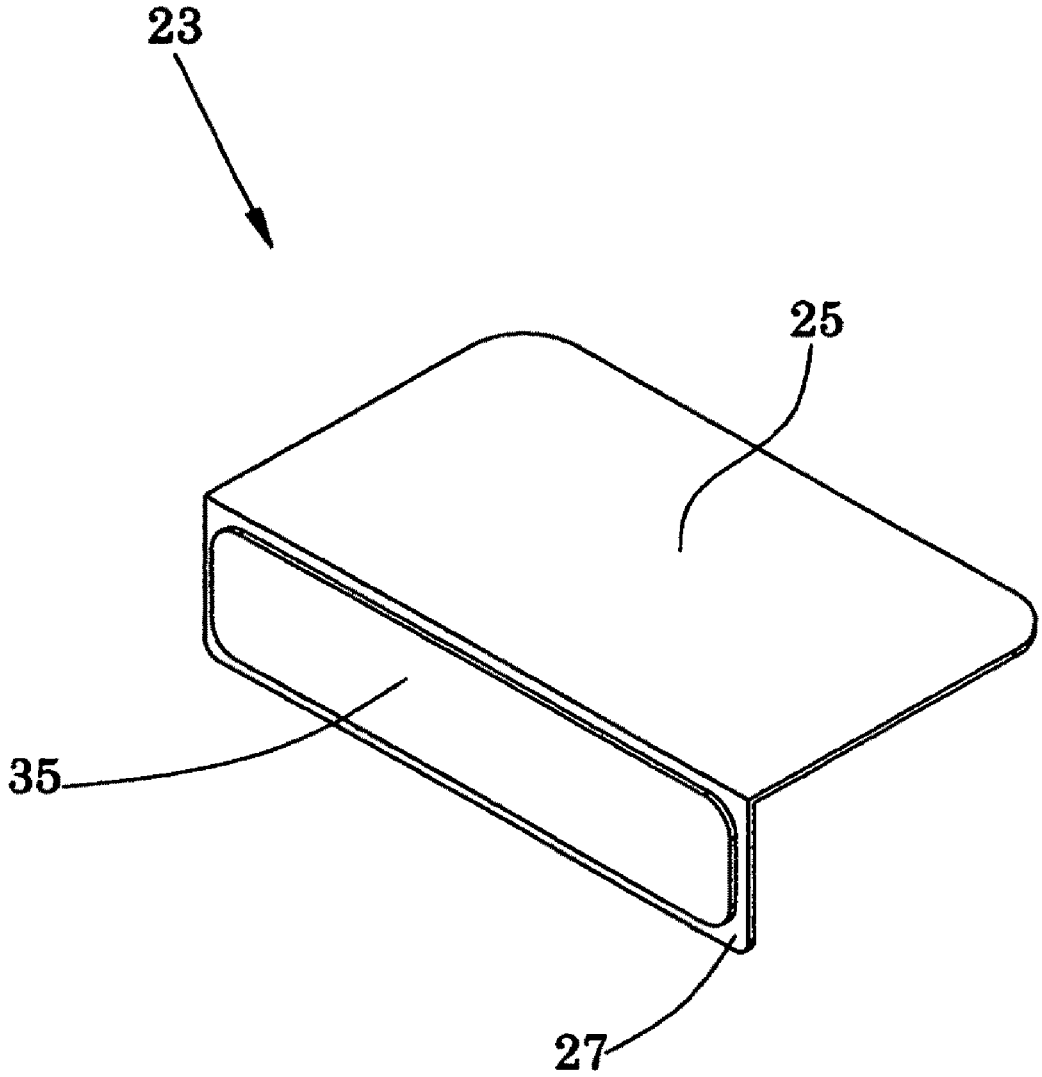
FIG. 12 shows a perspective view of a support shelf useful on a device according to one form of the invention.
Figure 13:
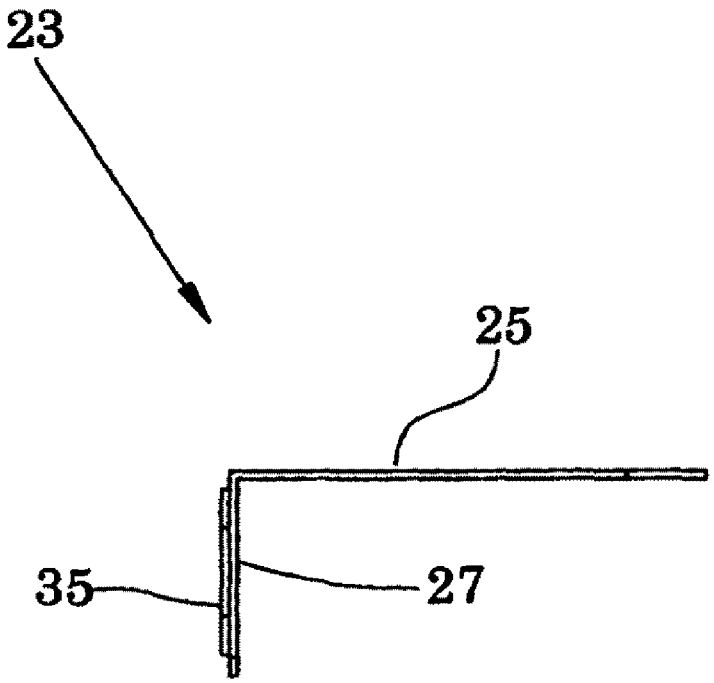
FIG. 13 shows a side view of a support shelf useful on a device according to one form of the invention.
Figure 14:
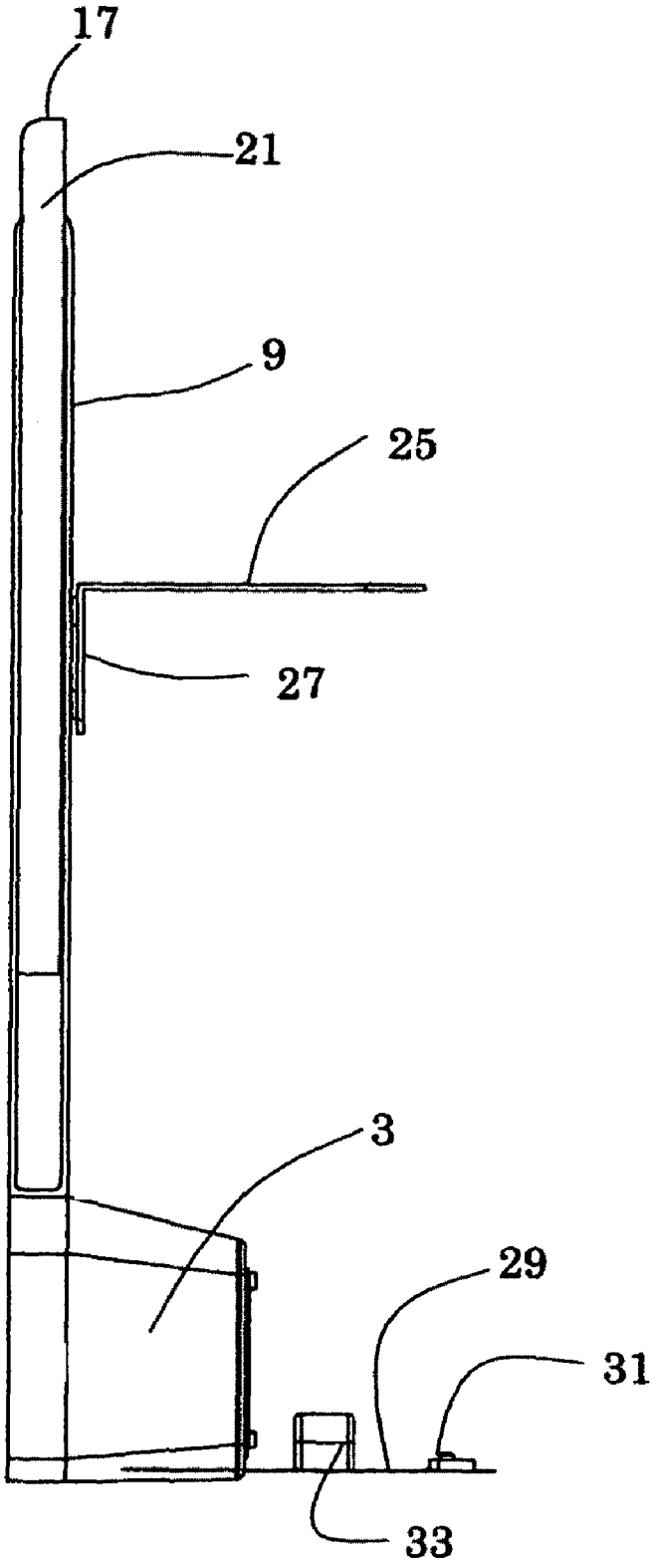
FIG. 14 shows a left side perspective view of a device according to one form of the invention having a support shelf according to one form of the invention attached thereto.
Figure 18:
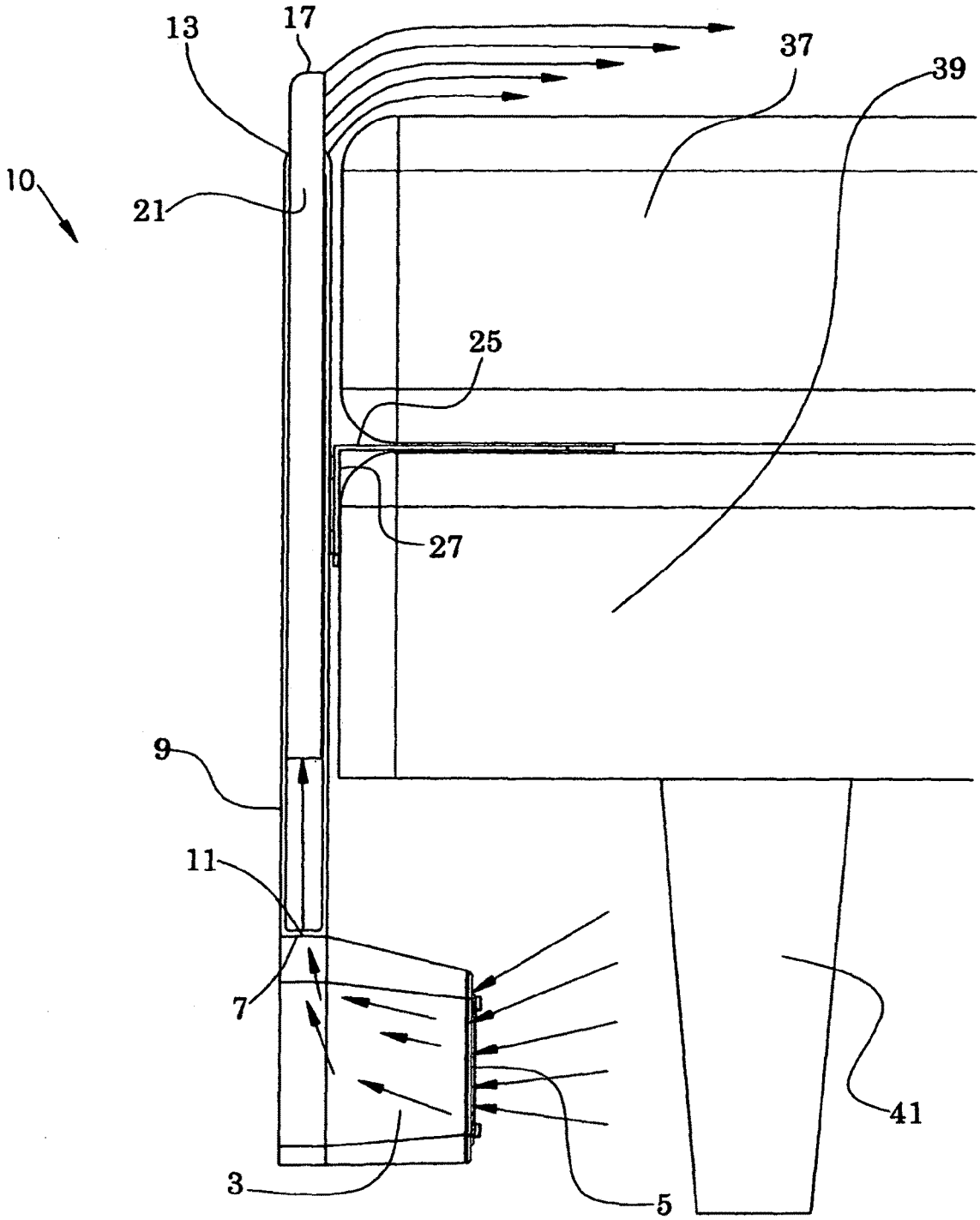
FIG. 18 shows a bed having a device according to the invention adjacent to the bed, wherein the bed is covered by a bed covering such as a sheet, wherein the device is supported by the support shelf such that the base portion is not in contact with the floor.

FIG. 12 shows a perspective view of a support shelf 23 useful on a device according to one form of the invention. The support shelf in one preferred form of the invention includes a first portion 25 and second portion 27, which are preferably comprised of flat sheet stock material joined together at about a 90° bend using conventional fastening means. Alternatively, the support shelf may be comprised of a single piece of sheet stock such as steel or thermoplastic polyolefin, which has a 90° bend in its structure. The second portion 27 is intended to be affixed to the rear face of the air conduit channel 9 as shown in FIG. 14, using conventional fastening means which may include hook-and-loop fastening means such as VELCRO® fastening means with one portion of the fastening means being attached to the surface of the second portion 27 of the support shelf 23 and the complementary counterpart fastening means being attached to the face of the device 10 of the invention. Such feature enables the support shelf to be selectively disposed in any desired position on the face of the air conduit channel means 9 to permit the first portion 25 of the support shelf means 23 to be inserted between a mattress and box spring to provide support for a device 10 according to the invention off the floor as depicted in FIG. 18. This adjustability feature, coupled with the adjustability of the distance of the support bar means 17 from the outlet end portion 13 of the air conduit channel renders a device according to the present invention sufficient adjustability of the present invention to enable its being usefully adapted to the vast majority of beds currently in use. FIG. 13 shows a side view of a support shelf 23 useful on a device according to one form of the invention and its various elements including its first portion 25 and its second portion 27. Hook-and-loop fastening means 35 is also shown disposed on the surface of the second portion 27.

FIG. 14 shows a left side perspective view of a device according to one form of the invention having a support shelf 23 (elements 25 and 27 collectively) according to one form of the invention attached thereto and having a support bar means 17 attached thereto as hereinbefore described and showing the respective locations of the various elements of the invention including the base portion 3, air conduit channel means 9, left support arm 21, the support bar means 17 and the power cord 29.

Figure 15:
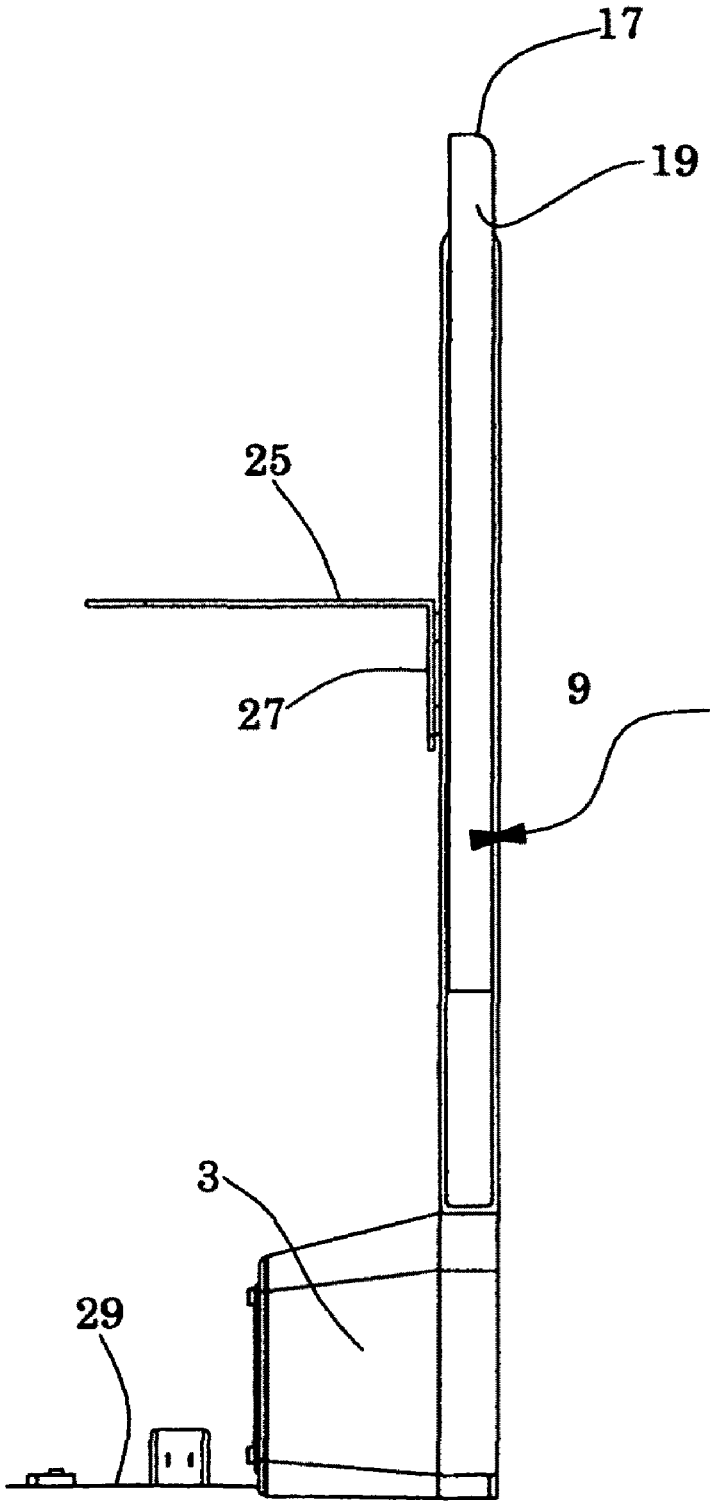
FIG. 15 shows a right side perspective view of a device according to one form of the invention having a support shelf according to one form of the invention attached thereto.

FIG. 15 shows a right side perspective view of a device according to one form of the invention having a support shelf 23 (elements 25 and 27 collectively) according to one form of the invention attached thereto and having a support bar means 17 attached thereto as hereinbefore described and showing the respective locations of the various elements of the invention including the base portion 3, air conduit channel means 9, right support arm 19, the support bar means 17 and the power cord 29.

Figure 16:
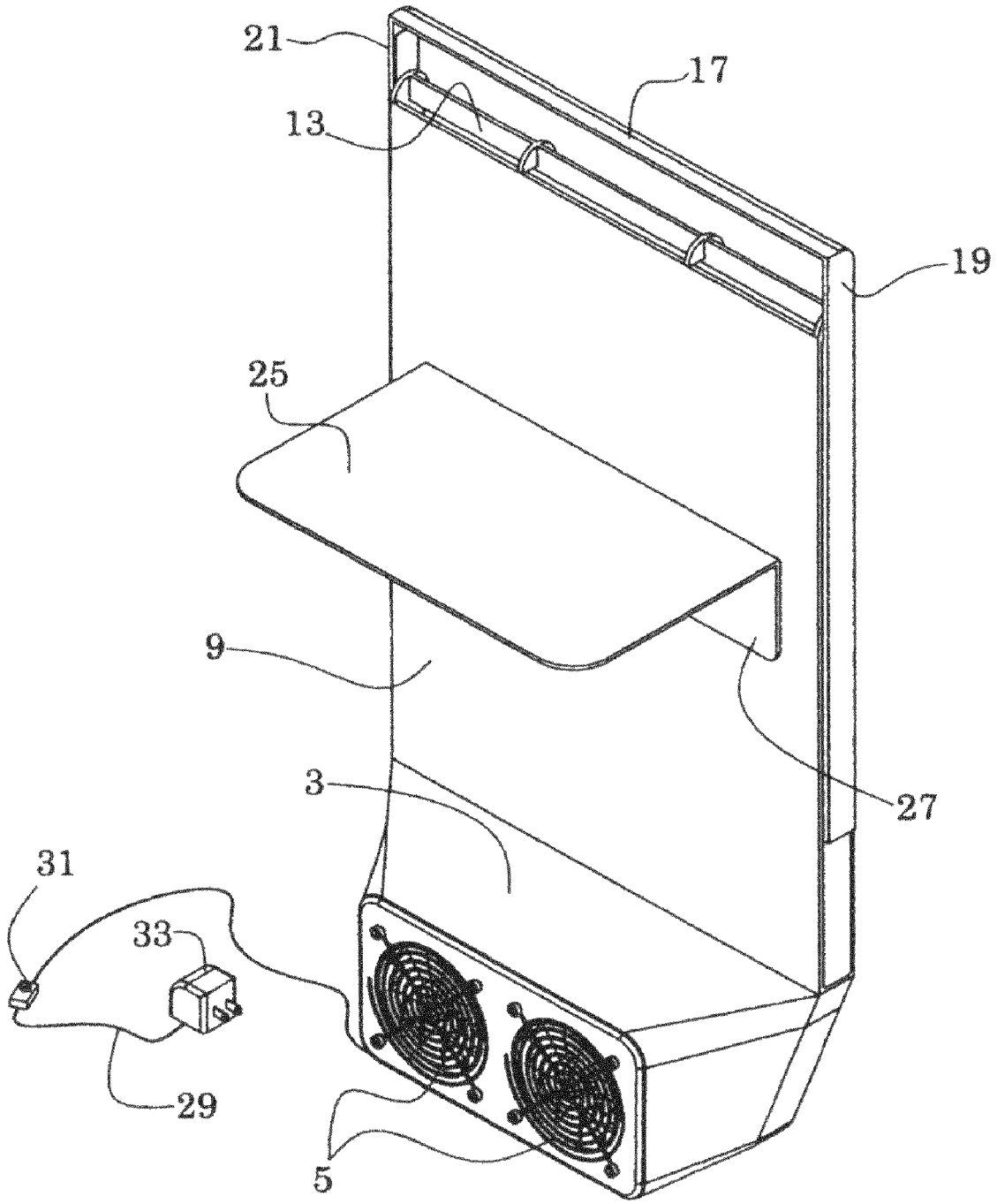
FIG. 16 shows a frontal perspective view of a device according to one form of the invention having a support shelf according to one form of the invention attached thereto.

FIG. 16 shows a frontal perspective view of a device according to one form of the invention having a support shelf according to one form of the invention attached thereto, and showing the respective locations of the various elements of this embodiment of the invention including the base portion 3, inlet opening 5 of the base portion 3, support shelf 23 (elements 25 and 27 collectively), the air conduit channel means 9, the outlet end portion 13 of the air conduit channel means 9, right support arm 19, left support arm 21 and support bar means 17.

Figure 17:
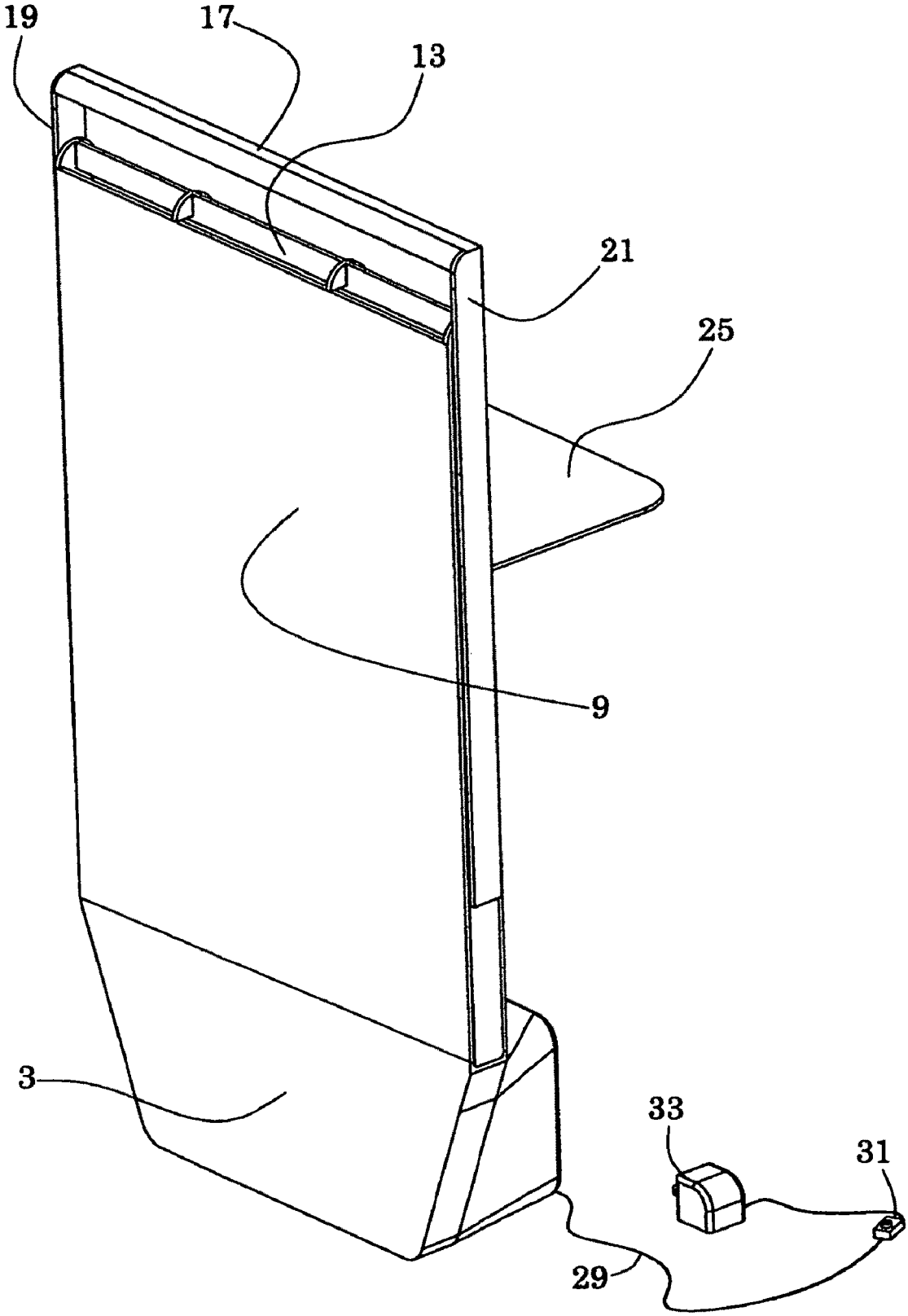
FIG. 17 shows a rear perspective view of a device according to one form of the invention having a support shelf according to one form of the invention attached thereto.

FIG. 17 shows a rear perspective view of a device according to one form of the invention having a support shelf according to one form of the invention attached thereto and showing the respective locations of the various elements of this embodiment of the invention, including the base portion 3, air conduit channel means 9, first portion of the support shelf 25, left support arm 21, right support arm 19, support bar means 17, and the outlet end portion 13 of the air conduit channel means 9.

FIG. 18 shows a bed having a device according to the invention adjacent to the bed, wherein the bed is covered by a bed covering such as a sheet, wherein the device is supported by the support shelf such that the base portion is not in contact with the floor. In this figure are shown the respective locations of the various elements of the invention in this embodiment in an actual use position installed on a bed, in which the first portion 25 of the support shelf 23 is shown sandwiched between a mattress 37 and a box spring 39 and wherein the second portion 27 of the support shelf 23 is shown attached to the front face of the air channel conduit means 9 thus supporting the device 10 as a whole off of the floor upon which the leg 41 of the bed is resting. As shown in this figure, air enters the base portion 3 as indicated by the arrows at the inlet opening 5 of the base portion 3 and is caused by the action of the fan means to exit the base portion 3 at the exit opening 7 of the base portion 3 and to enter the inlet end portion 11 of the air conduit channel means 9, through which it is forced upward through the air conduit channel means 9 and out of its outlet end portion 13, whereupon it impinges upon the support bar means 17 and is re-directed in a direction as indicated by the arrows to be substantially parallel to the top surface of the mattress 37, thus providing ventilation for a person resting on the bed.

Figure 19:
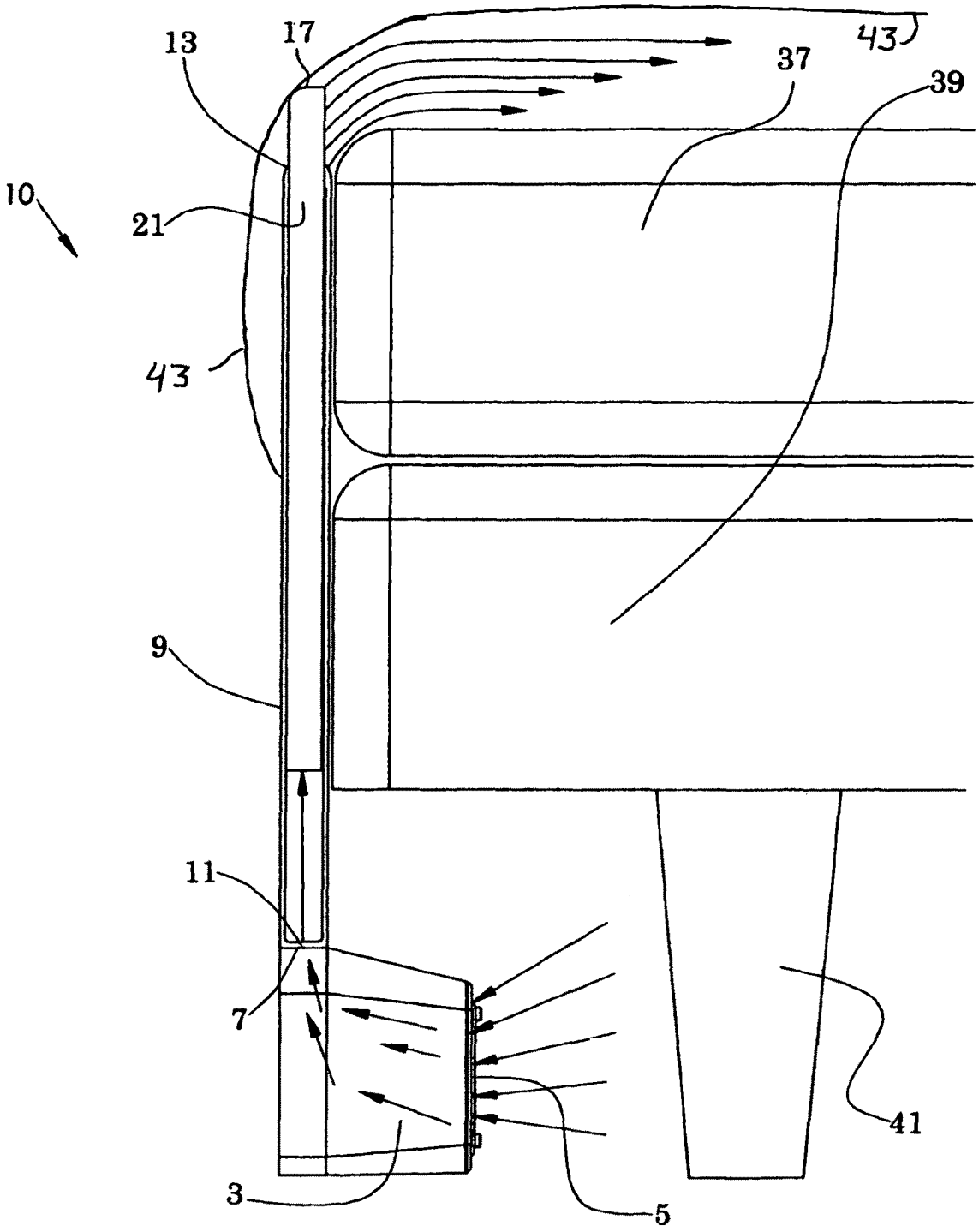
FIG. 19 shows a bed having a device according to the invention adjacent to the bed.

FIG. 19 shows a bed equipped with a device according to the present invention, wherein the inventive device is resting on the floor. In this figure are shown the respective locations of the various elements of the invention in this embodiment. As shown in this figure, air enters the base portion 3 as indicated by the arrows at the inlet opening 5 of the base portion 3, and is caused by the action of the fan means to exit the base portion 3 at the exit opening 7 of the base portion 3 and to enter the inlet end portion 11 of the air conduit channel means 9, through which it is forced upward through the air conduit channel means 9 and out of its outlet end portion 13, whereupon it impinges upon the support bar means 17 and is re-directed in a direction as indicated by the arrows to be substantially parallel to the top surface of the mattress 37, thus providing ventilation for a person resting on the bed. In this figure is also shown the bed covering, which may be a blanket, sheet, etc. which is in contact with the support bar. The purpose of the support bar in this embodiment is twofold: 1) to re-direct the direction of the air as previously explained; and 2) to support the bed covering so as to prevent its interference with the air flow out of the outlet end portion 13 of the air channel means 9. Thus, the support bar means 17 holds the bed covering up off of the opening at the outlet end portion 13 of the air channel means, which enables the full air flow to ventilate the volume between the bedcovering and the top surface of the mattress 37, which usually will contain a person residing thereon.

Figure 20:
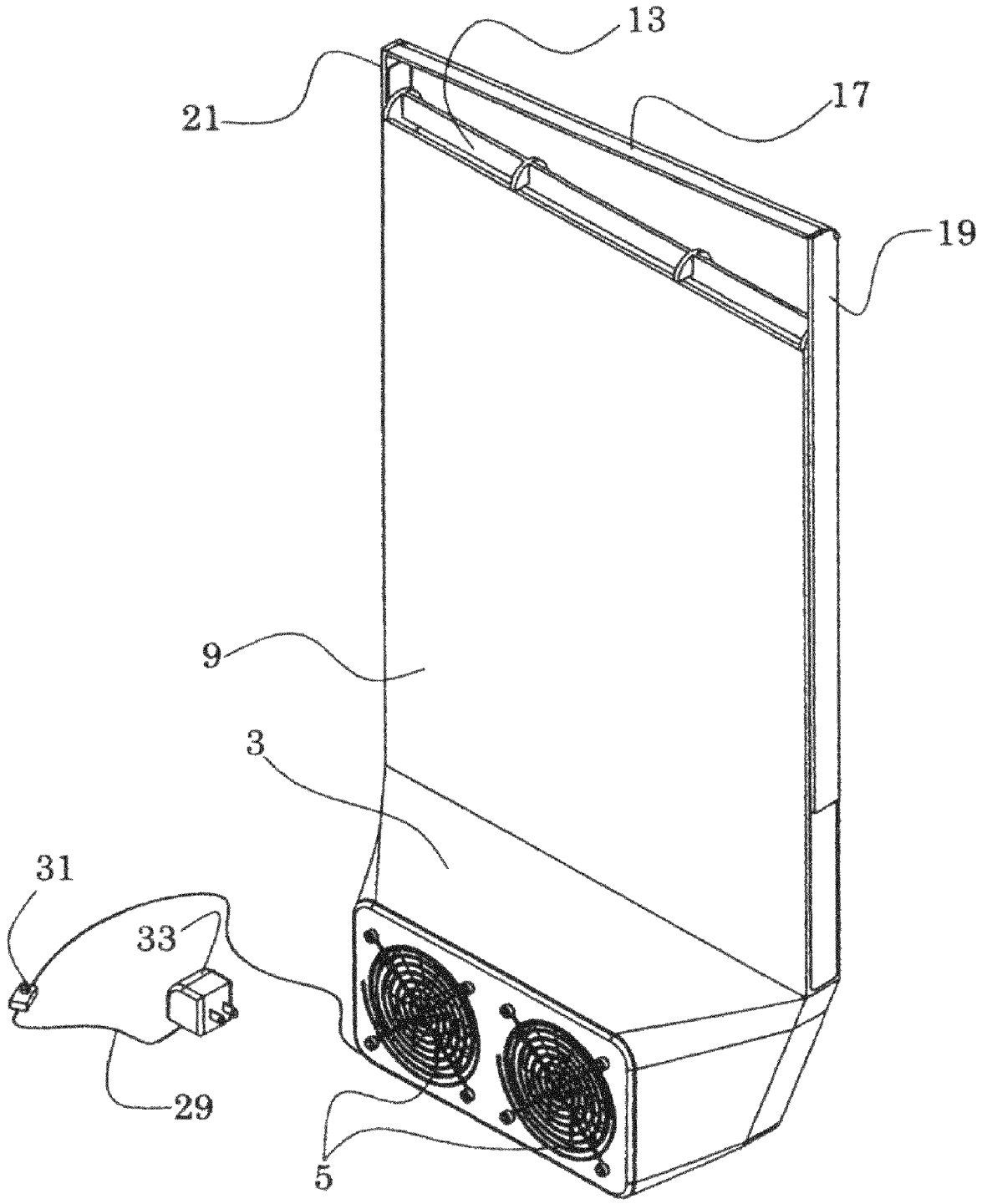
FIG. 20 shows a device according to an alternate form of the invention.

FIG. 20 shows a frontal perspective view of a device according to an alternate form of the invention having a support shelf according to one form of the invention attached thereto; and showing the respective locations of the various elements of this embodiment of the invention including the base portion 3, inlet opening 5 of the base portion 3, support shelf 23 (elements 25 and 27 collectively), the air conduit channel means 9, the outlet end portion 13 of the air conduit channel means 9, right support arm 19, left support arm 21 and support bar means 17. In this embodiment the support bar means 17 is disposed so that it is not parallel to the outlet end portion of the air conduit channel means 13. Such an embodiment has the advantage that by adjusting the angle which the support bar means 17 makes with respect to the horizontal surface upon which the bed rests, it is possible to elevate a portion of the bed sheets to a level that is higher than other portions of the bed sheets, to effectuate increased variability in the ability to control ventilating air flow when using a device according to the invention.

Figure 21:
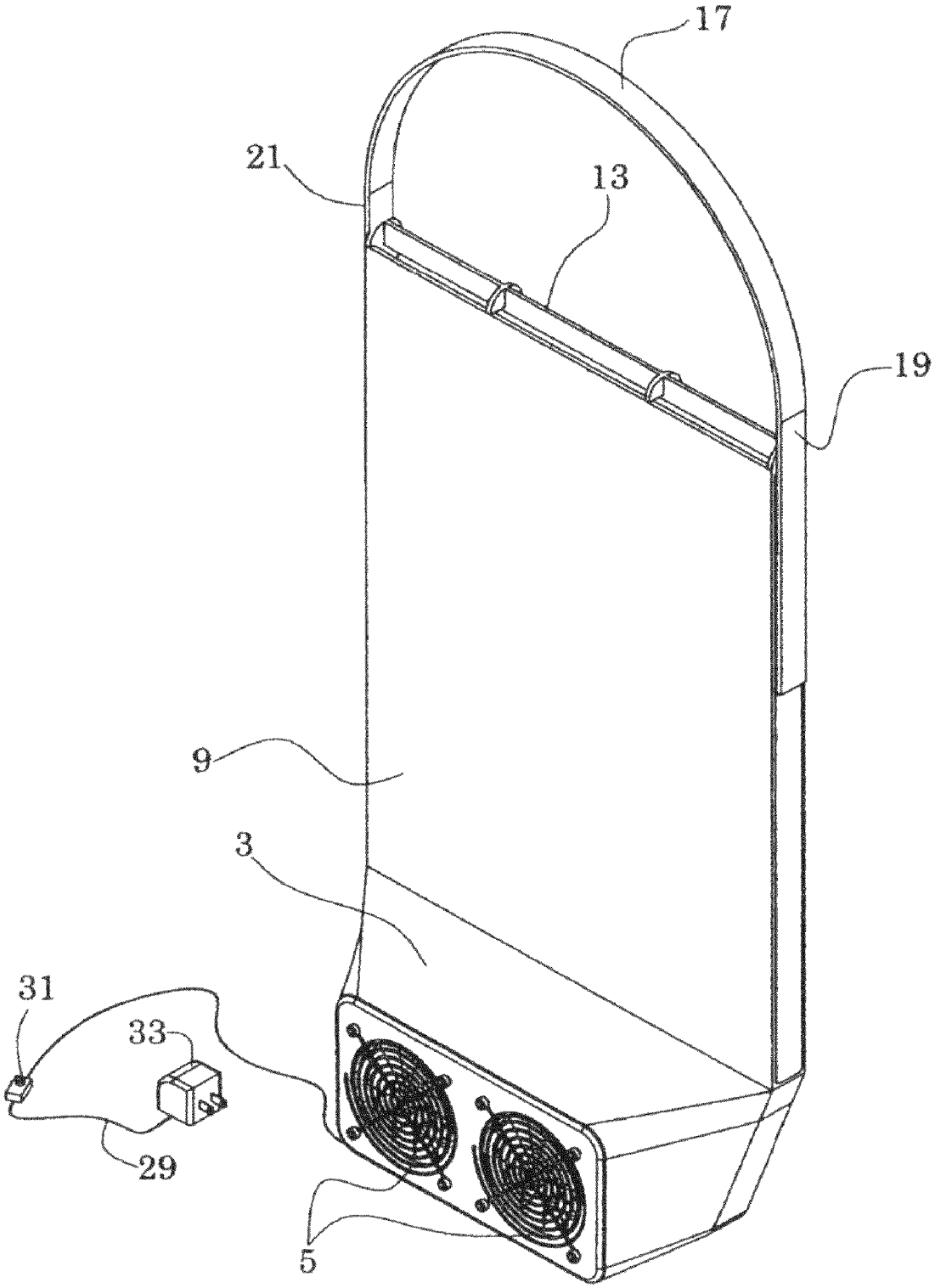
FIG. 21 shows a device according to an alternate form of the invention.

FIG. 21 shows a frontal perspective view of a device according to an alternate form of the invention having a support shelf according to one form of the invention attached thereto, and showing the respective locations of the various elements of this embodiment of the invention including the base portion 3, inlet opening 5 of the base portion 3, support shelf 23 (elements 25 and 27 collectively), the air conduit channel means 9, the outlet end portion 13 of the air conduit channel means 9, right support arm 19, left support arm 21 and support bar means 17. In this embodiment the support bar means 17 is not substantially linear and flat as in other embodiments described herein, but rather is curved, which again enables increased variability with respect to the flow of ventilating air exiting the outlet end portion 13 of the air conduit channel means 9.

In one preferred form of the invention, the air channel means has a width of about 12 inches and a length of about 16 inches and comprises a channel which is 1 inch deep and about 12 inches long. The volume of air delivered is adjustable in the range of between about 1 cubic foot per minute to about 300 cubic feet per minute. In many climates, such airflow is believed to eliminate the need for night time air conditioning, thus saving on energy costs associated with cooling an entire room. The fan means may be any fan capable of moving volumes of air in the above range.

Thus, after consideration of all described in this specification, it is now clear that the present invention provides an excellent means for ventilation for a person resting in a bed. The adjustability of the airflow, via the rheostat means, which may be located at the person's hand, enables selective control of between-sheet air flow. This adjustability is especially helpful for persons suffering from night-sweats, and women experiencing hot flashes from menopausal changes in body function, and has been well-received by all persons thus far having tested the device on themselves, who all have indicated that this invention has enhanced their ability to achieve restful sleep.

While particular embodiments have been described herein having particular specified physical dimensions, the present invention, including its various component parts, shall not be construed as to being limited to any specific size dimension. In fact it is one of the benefits of the present invention that its component parts are readily altered in size to afford a device according to the invention which is capable of being retrofitted to just about any bed of the prior art.

Consideration must be given to the fact that although this invention has been described and disclosed in relation to certain preferred embodiments, obvious equivalent modifications and alterations thereof will become apparent to one of ordinary skill in this art upon reading and understanding this specification and the claims appended hereto. This includes subject matter defined by any combination of any one of the various claims appended hereto with any one or more of the remaining claims, including the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. This also includes combination of the features and/or limitations of one or more of the independent claims with features and/or limitations of another independent claims to arrive at a modified independent claim, with the remaining dependent claims in their original text being read and applied to any independent claim so modified. Accordingly, the presently disclosed invention is intended to cover all such modifications and alterations, and is limited only by the scope of the claims which follow.

What is claimed is:

1. An apparatus comprising a ventilating device together in combination with a bed and bed cover, said apparatus comprising:

an injection molded base portion of single construction, an air conduit channel, and a fan, wherein the fan is disposed within the base portion;

said base portion having a hollow interior portion and further comprising:

i) at least one inlet opening through which air may be admitted, and ii) an exit opening through which air may exit in a substantially vertical direction;

said air conduit channel having an inlet end portion and an outlet end portion;

wherein said inlet end portion of said air conduit channel is in effective fluid communication with said exit opening of said base portion, said air conduit channel connecting with the base portion so that air is discharged from the base portion in a substantially vertical direction and flows upwardly through the air conduit channel from the inlet end portion to the outlet end portion; and wherein said outlet end portion defines a ventilating exit through which air may exit the device;

the base portion functioning as a support for the air conduit channel, said air conduit channel extending upwardly form the base portion;

said at least one fan disposed between said inlet opening in said base portion and said outlet end portion of said air conduit channel for causing ambient air to follow from said inlet opening of said base portion to the outlet end portion of said air conduit channel;

a bed comprising a mattress having a top surface, the base portion of the housing being disposed beneath the bed;

a bed covering disposed upon the top surface of said mattress; a volume of air being defined between the top surface of said mattress and said bed covering, said air conduit channel extending upwardly alongside the mattress beneath the bed covering so that air is expelled out of said air outlet end portion of said air conduit channel and into said volume of air; and two adjustably positioned support arms attached between a support bar and said air conduit channel to provide adjustment of a spacing between the support bar and the ventilating exit, wherein said support bar is adjustably positioned by the support arms to be directly in the path of air exiting said ventilating exit;

wherein said adjustably positioned support arms are attached to said air conduit by hook-and-loop fasteners.

2. The apparatus according to claim 1 wherein said support bar is disposed to be substantially parallel to the outlet end portion of said air conduit channel.

3. The apparatus according to claim 2 wherein the support bar is disposed to be within the flow of air exiting said ventilating exit sufficiently to substantially alter the direction of flow of air exiting said air conduit.

4. The apparatus according to claim 2 wherein the support bar alters the direction of flow of air exiting said ventilating exit in an amount of between about 45 degrees and about 90 degrees.

5. The apparatus according to claim 2 wherein the support bar is substantially linear and is disposed to be non-parallel to the outlet end portion of the air conduit.

6. The apparatus according to claim 2 wherein said support bar is curved.

7. The apparatus according to claim 1 wherein said base portion comprises a flat lower surface which is adapted to rest on a substantially horizontal floor which supports the bed.

8. The apparatus according to claim 7 wherein said air conduit channel is substantially vertically disposed with respect to the flat lower surface of said base portion.

9. The apparatus according to claim 1 wherein said air conduit channel is substantially rectangular in cross-section.

10. The apparatus according to claim 1 wherein the outlet end portion of the air conduit channel does not extend over the top surface of the mattress.

11. The apparatus according to claim 1 wherein the direction of air admitted into the inlet opening of the base portion is substantially perpendicular to the direction of the flow of air through the air conduit channel.

12. The apparatus according to claim 1 further comprising a support shelf attached to said air conduit channel, said support shelf being inserted underneath the mattress.

13. The apparatus according to claim 12 wherein said support shelf is adjustably attached to said air conduit channel.

* * * * *